US010590717B2

(12) United States Patent
Smith et al.

(10) Patent No.: US 10,590,717 B2
(45) Date of Patent: Mar. 17, 2020

(54) CENTRALIZER SYSTEM

(71) Applicant: ALASKAN ENERGY RESOURCES, INC., Anchorage, AK (US)

(72) Inventors: Lee Morgan Smith, Anchorage, AK (US); Alf K. Sevre, Houston, TX (US); Pierre Rene Cortes, Abu Dhabi (AE)

(73) Assignee: ALASKAN ENERGY RESOURCES, INC., Anchorage, AK (US)

( * ) Notice: Subject to any disclaimer, the term of this patent is extended or adjusted under 35 U.S.C. 154(b) by 0 days.

(21) Appl. No.: 16/103,181

(22) Filed: Aug. 14, 2018

(65) Prior Publication Data

US 2018/0355680 A1 Dec. 13, 2018

Related U.S. Application Data

(62) Division of application No. 15/160,961, filed on May 20, 2016, now Pat. No. 10,053,925.

(51) Int. Cl.
*E21B 17/10* (2006.01)

(52) U.S. Cl.
CPC ..... *E21B 17/1078* (2013.01)

(58) Field of Classification Search
CPC ..... E21B 17/1078
See application file for complete search history.

(56) References Cited

U.S. PATENT DOCUMENTS

RE19,339 E 10/1934 Vertson
3,285,678 A 11/1966 Garrett et al.
3,322,217 A 5/1967 Orr
3,420,323 A 1/1969 Owens
4,081,203 A 3/1978 Fuller
4,231,437 A 11/1980 Swersky et al.
4,277,869 A 7/1981 Hartwell
4,385,669 A 5/1983 Knutsen
(Continued)

FOREIGN PATENT DOCUMENTS

WO 2013167954 A1 11/2013

OTHER PUBLICATIONS

"Hydro-Formed Casing Centralizer." Schlumberger.
(Continued)

*Primary Examiner* — Kristyn A Hall
(74) *Attorney, Agent, or Firm* — Nolte Intellectual Property Law Group

(57) ABSTRACT

A stress-free centralizer system for wellbore tubulars having a centralizer portion with hollow vanes or solid vanes. An injectable material can be configured to harden at ambient or elevated temperatures and installed into the hollow vanes while coating a portion of the inner surface of the centralizer portion. Alternatively, a swellable encapsulation and shape shifting material can be used instead of the injectable material. Additionally, primers and adhesives can be used with the centralizer portion. Both materials when hardened or swollen can be configured to withstand temperatures and pressures within a wellbore for twenty-four hours without melting or degrading. The centralizer portion can simultaneously prevent axial movement and rotational movement while installed on the wellbore tubular, distribute load evenly around the centralizer portion, and provide cathodic protection to the wellbore tubular without using a stop collar with screws.

7 Claims, 21 Drawing Sheets

(56) References Cited

U.S. PATENT DOCUMENTS

| | | | | |
|---|---|---|---|---|
| 4,610,316 | A | 9/1986 | Boaz | |
| 4,664,206 | A | 5/1987 | Butler | |
| 4,766,663 | A | 8/1988 | Milam | |
| 5,330,016 | A | 7/1994 | Paske | |
| 7,650,952 | B2 | 1/2010 | Evans et al. | |
| 8,162,081 | B2 | 4/2012 | Ballard et al. | |
| 8,443,882 | B2 | 5/2013 | Barnard et al. | |
| 8,607,900 | B1 | 12/2013 | Smith | |
| 8,991,487 | B2 | 3/2015 | Levie et al. | |
| 9,145,746 | B1 | 9/2015 | Smith | |
| 9,151,118 | B2 | 10/2015 | Robson | |
| 9,151,119 | B1 | 10/2015 | Smith | |
| 2010/0051349 | A1 | 3/2010 | Ballard | |
| 2010/0276138 | A1 | 11/2010 | Wittman | |
| 2011/0253457 | A1 | 10/2011 | Shen | |
| 2012/0255786 | A1 | 10/2012 | Isenhour | |
| 2013/0000989 | A1 | 1/2013 | Sherrill | |
| 2014/0202770 | A1 | 7/2014 | Zaki et al. | |
| 2014/0246247 | A1 | 9/2014 | Smith | |
| 2014/0311756 | A1* | 10/2014 | Dicke | E21B 17/1028 166/381 |
| 2015/0300100 | A1* | 10/2015 | Angman | E21B 17/10 166/380 |

OTHER PUBLICATIONS

"Radial Tubular Forming Tool (RTF-13.38.)" Volant (Nov. 2014).
"Radial Tubular Forming Tool (RTF-9.63.)" Volant (Nov. 2014).
"Radial Tubular Forming Tool (RTF-7.0.)" Volant (Dec. 2015).

* cited by examiner

CENTRALIZER SYSTEM

CROSS-REFERENCE TO RELATED APPLICATIONS

The present application is a divisional of U.S. patent Ser. No. 15/160,961 filed on May 20, 2016, for "Centralizer System". This reference is hereby incorporated in its entirety.

FIELD

The present embodiments generally relate to a stress-free centralizer system for use with wellbore tubulars.

BACKGROUND

A need exists for a stress-free centralizer system that provides two different physical properties during operation to centralize a drill string in a wellbore.

A need exists for a stress-free centralizer system configured to simultaneously (i) prevent axial movement of the centralizer portion about the wellbore tubular, (ii) prevent rotational movement of the centralizer portion while installed on the wellbore tubular, (iii) distribute load evenly preventing stress riser around the centralizer portion, and (iv) provide cathodic protection to the wellbore tubular without using a stop collar fastened to the tubular.

The present embodiments meet these needs.

BRIEF DESCRIPTION OF THE DRAWINGS

The detailed description will be better understood in conjunction with the accompanying drawings as follows.

Figure 1A:
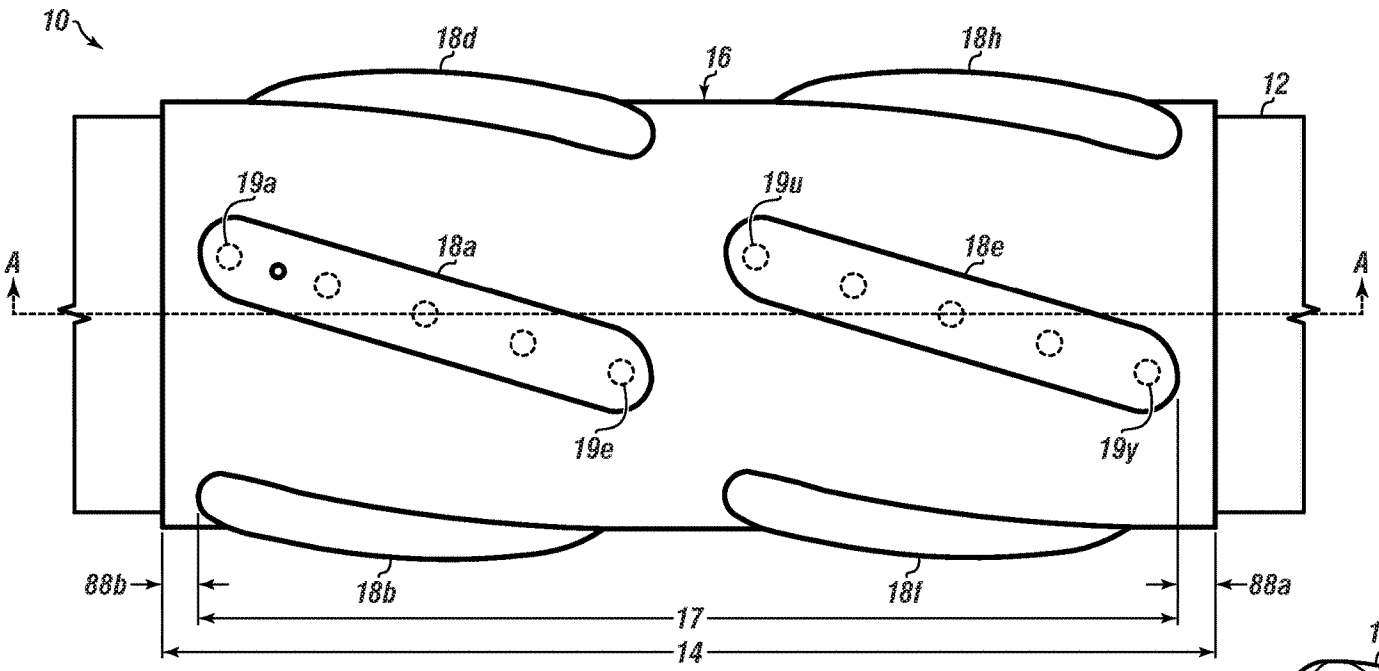
FIGS. 1A-1E depict a hollow vane embodiment of a stress-free centralizer system for wellbore tubulars.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a stress-free centralizer system for use with wellbore tubulars.

The various embodiments further relate to a stress-free centralizer system for wellbore tubulars, a hollow vane version, a solid vane version and a clamp receiving version.

If hollow vanes are used, an injectable material or a swellable encapsulation and shape shifting material can be used to fill the hollow vanes and then harden at ambient or elevated temperatures while simultaneously filling an annulus between a centralizer portion and a wellbore tubular.

In embodiments, hollow vanes, hollow pads, and solid vanes can be oriented helically around a longitudinal axis of the centralizer portion.

If solid vanes are used, an injectable material or a swellable encapsulation and shape shifting material can be used to fill an annulus between a centralizer portion and a wellbore tubular. In embodiments, the injectable material can be in a liquid state.

The injectable material and swellable encapsulation and shape shifting material can be selected to withstand temperatures and pressures within a wellbore for twenty-four hours without melting or degrading.

A feature of the invention is that the centralizer portion can simultaneously do several functions, (a) prevent axial movement and rotational movement while installed on the wellbore tubular, (b) distribute load evenly around the centralizer portion, and (c) provide cathodic protection to the wellbore tubular without using a stop collar with screws.

A benefit of the invention is that this centralizer can be created at a lower cost than commercially available centralizers enabling the cost to remove hydrocarbons to be lower, which ultimately provides a lower gas price which can help people on a fixed budget.

Another benefit of the invention is that this centralizer is stronger than single component centralizers lasting longer without creating environmental incidents downhole.

A benefit of the invention is that the centralizer can be made such that the centralizer exhibits two or three different physical properties simultaneously due to the incorporation of different materials into the centralizer. In embodiments, the vanes can be made of one material, such as steel, and the body of the centralizer can be made of a different material, such as a reinforced polymer. The flutes of the centralizer can be coated in a second material, such as a composite graphite to move fluid up well easier than the vanes for example.

Yet another benefit of the invention is that no collar with screws needed to hold the tubular to the centralizer. By eliminating the need for screw holes and screws, the invention can seal more securely preventing well fluid spills and toxic leaks.

In embodiments, the stress free centralizer system can be used in wellbores having a drilled hole size of 5 inches to 36 inches. However, other drilled hole sizes can be used for the centralizer system if the outer diameter of the centralizer system body varied in outer diameter to being larger or smaller.

Specific structural and functional details disclosed herein are not to be interpreted as limiting, but merely as a basis of the claims and as a representative basis for teaching persons having ordinary skill in the art to variously employ the present invention.

Injectable Materials and Swellable Materials:

Epoxy resins can be used herein as an injectable material. Epoxies, also known as polyepoxides, are a class of reactive prepolymers and polymers which contain epoxide groups. Epoxy resins can be reacted (cross-linked) either with themselves through catalytic homopolymerisation, or with a wide range of co-reactants including polyfunctional amines, acids (and acid anhydrides), phenols, alcohols and thiols. These co-reactants can often be referred to as hardeners or curatives, and the cross-linking reaction can be commonly referred to as curing. Reaction of polyepoxides with themselves or with polyfunctional hardeners forms a thermosetting polymer, often with high mechanical properties, temperature and chemical resistance.

In embodiments, usable plastic injectable materials can be polypropylene, polyethyelene homopolymers and copolymers thereof.

In embodiments, the injectable material can be an ethylene propylene diene monomer rubber or other synthetic rubbers.

The injectable material can be configured to harden to a hardness of at least 50 shore A and withstand temperatures and pressures within a wellbore for at least twenty-four hours without melting or degrading after hardening within each of the plurality of hollow vanes and annulus.

In embodiments, a swellable encapsulation and shape shifting material can be used.

The swellable encapsulation and shape shifting material can be an elastic polymer, ethylene propylene diene monomer rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber or polynorbornene. The elastic polymer can swell in contact with and by absorption of hydrocarbons so that the packer expands. Additional options can incorporate into the elastic polymer a polyvinyl chloride, such as methyl methacrylate, acrylonitrile, ethylacetate or other polymers expanding by contact with oil.

Additionally, elastic polymers can be acrylonitrile, hydrogenated nitrile, chloroprene, ethylene vinylacetate rubber, silicone, ethylene propylene diene monomer, butyl, chlorosulphonated polyethylene, polyurethane, a thermoplastic or a thermosetting polymer. The usable elastic polymer can have a higher resistance towards hydrocarbons than rubber and swells only to a small degree upon exposure to hydrocarbons.

In embodiments, both oil swell and water swell polymers can be used. Several elastic polymers can have a considerable absorption of hydrocarbons without absorption of water, and the polymers in the present invention are predominantly hydrophobic. By immersion in a hydrocarbonaceous medium, hydrocarbons can migrate into the polymer which swells upon absorption of these materials.

In embodiments, the centralizer portion can generally be tubular having an annulus and a longitudinal axis.

In embodiments, the centralizer portion can range in length from 2 inches to 48 inches and have an outer diameter from 3 inches to 36 inches.

In embodiments, the centralizer portion can be made from a metal, such as steel, or a reinforced polymer with a hardness in excess of 50 shore A.

In embodiments, the centralizer portion can have a vane portion and extensions, the extensions can extend from 1 inch to 20 inches from the vane portion, extending on either side of the vane portion.

The centralizer can have an outer surface, which can support the vanes, and an inner surface, which can support a wellbore tubular.

Vanes

The vane portion of the centralizer portion can be from 20 percent to 100 percent the length of the centralizer portion or range from 1 percent to 400 percent the length of the centralizer.

The vane portion can have hollow vanes, solid vanes or pads, which can extend away from the surface of the vane portion. In embodiments, the vanes can be continuous from one end of the vane portion to the other end. In embodiments, the vanes can be discontinuous from one end of the vane portion to the other. The pads can be discrete elements from each other extending along the vane portion outer surface.

In embodiments, the vane portion can be connected on one end to an extension with a first chamfered edge and on the other end with a second chamfered edge. The first chamfered edge can be a sloped edge rising at a first angle from 1 degree to 20 degrees from the longitudinal axis. The second chamfered edge can be a sloped edge rising at a second angle from 1 degree to 20 degrees from the longitudinal axis. In embodiments, the first and second chamfered edges can have different slopes.

In embodiments, an epoxy system or polymeric system, such as a resin can be layered over the outer surface of the vane portion forming a resin layer with a defined flexibility and durometer. In embodiments, vanes can be secured to the epoxy or polymeric system, such as the resin that can be disposed on the outer surface.

In embodiments, the vanes or pads can be formed on a vane portion of the centralizer that is integrally connected between the first and second chamfered edges.

In embodiments, the vane portion can have a vane surface. The vanes can be either hollow or solid, or the pads can be either hollow or solid extending away from the vane surface.

In embodiments, a wellbore gap can be formed between the vanes or pads and the wellbore or casing of a well.

In embodiments, the vanes or pads can be formed from the same material as the vane surface and can be integral with the vane surface.

In embodiments, an epoxy or resin can be layered to the vane surface forming a resin layer with a defined flexibility and durometer, and then the vanes or pads can be secured to the epoxy or resin layer on the vane surface.

In embodiments, the vane surface can be formed from the same material as the outer surface of the centralizer portion.

In embodiments, the vanes or pads can be a different metal from the material of the vane surface.

In embodiments, the vanes, pads and vane surface can be different metals from the outer surface of the centralizer portion enabling two or three different physical properties to be used simultaneously for the centralizer portion.

For example, the pads or vanes can be formed from a material that provides a hard surface and the vane surface can be formed from a material that provides cathodic protection to the wellbore tubular.

In other embodiments, the vane surface can be a material that allows some flexing while the vanes can be formed from a hard material.

In embodiments, the injectable material in the hollow pads or hollow vanes can impart a fourth physical property for the centralizer system all simultaneously.

In embodiments, the vanes or pads can be disposed equidistantly around the vane surface of the centralizer.

In embodiments, the vane portion of the centralizer can have vanes that extend away from the outer surface of the centralizer portion from ⅛ of an inch to ¼ of an inch.

In embodiments, the vanes can extend from 0.5 inches to 8 inches longitudinally down the vane portion.

In embodiments, the vanes can be offset from each other.

In embodiments, the pads can be offset from each other. For instance, some pads can be formed in rows or some pads can be formed in patterns, such as X patterns or H patterns.

In embodiments, the vanes or pads can be formed in zones or preset areas of the centralizer portion. Some areas can be discrete from other portions or zones.

In embodiments, the vanes can be helically disposed around the centralizer portion in parallel with each other and in parallel to a longitudinal axis of the centralizer portion.

In embodiments, from 2 vanes to 25 vanes can be used that can extend from one end of the centralizer portion to the other end. In embodiments, from 3 vanes to 12 vanes can be used, wherein each vane can be contiguous from a first end to a second end of the vane portion.

In embodiments, discrete pads can be used instead of vanes. From 2 discrete pads to 100 discrete pads can be used, with each pad extending from the vane portion. The discrete pads, like the vanes, can be disposed equidistantly around the vane portion of the centralizer.

Each of the discrete pads can have a wall thickness for containing an epoxy system or polymeric system. The wall thickness can range from 1/16 of an inch to 1 inch.

In embodiments, the vanes or pads can be hollow with thru-holes. The thru-holes can enable the hollow vanes or hollow pads to receive a liquid injectable material that hardens. The liquid injectable material can be injected through the thru-holes while in a liquid state, once in the hollow pads or hollow vanes, the liquid injectable material hardens within the hollow vanes or hollow pads forming a different property from the metal the vane can be constructed from. In embodiments, the injectable material can impart both a different flexibility and a different durometer and a different ionic property from the outer material containing the liquid injectable material.

In embodiments, from 1 thru-hole to 5 thru-holes can be used with each hollow vane or hollow pad.

In embodiments, all vanes or pads can be injected with the liquid injectable material simultaneously enabling hardening to occur simultaneously and quick creation of this stress-free centralizer.

In embodiments, ports can be formed in each hollow vane or pad. The ports can be configured to receive a portion of swellable encapsulation and shape shifting material in place of the liquid injectable epoxy system or polymeric resin system. As the injectable material hardens or swells, the holes and ports can close.

In embodiments, flutes can extend into the centralizer portion without penetrating to the annulus to provide a different form of flexibly simultaneously with a particulate moving pathway as the centralizer is used. The flutes can extend into the vane portion from 2 percent to 90 percent of the thickness of the vane portion.

Adhesive and Primer

In embodiments, primer and then adhesive can be layered onto the centralizer portion or the wellbore tubular which can be secured to the centralizer portion.

When this embodiment is used, the adhesive can be TY-PLY® BN adhesive, available from the Lord Corporation.

In embodiments, the adhesive can be a layer of adhesive that is discontinuous.

In embodiments, the adhesive can be a layer of adhesive ranging in thickness from 0.001 inches to 0.25 inches.

In embodiments, the primer can be a metal substrate primer such as CHEMOSIL® 211, also from Lord Corporation.

In embodiments, the primer can be a layer of primer that is discontinuous.

In embodiments, the primer can be a layer of primer ranging in thickness from 0.001 inches to 0.25 inches.

In embodiments, primer and adhesive can be applied to an inner diameter of the centralizer portion.

In embodiments, the primer can be applied to an outer surface of a wellbore tubular and then adhesive can he applied over the primer.

In embodiments, to form the stress-free centralizer, a portion of the wellbore tubular can be first sanded and then primer applied. A layer of adhesive can be applied to the primer layer. The annulus portion of the centralizer can be slid over the wellbore tubular forming a tight connection with the adhesive. In embodiments, the hollow vanes or pads can be pre-filled with the epoxy or resin.

Figure 1B:
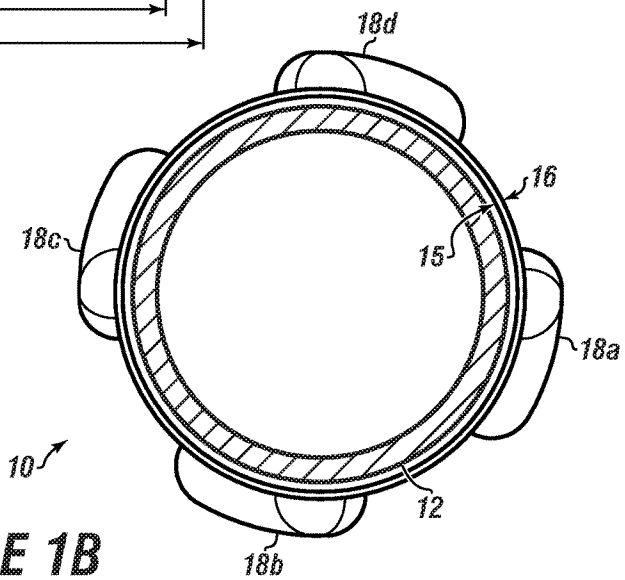

Turning now to the Figures, FIGS. 1A-1E depict a hollow vane embodiment of a stress-free centralizer system for wellbore tubulars. FIG. 1A is a side view with cutline A-A. FIG. 1B is a cross sectional view along the cutline A-A.

Figure 1C:
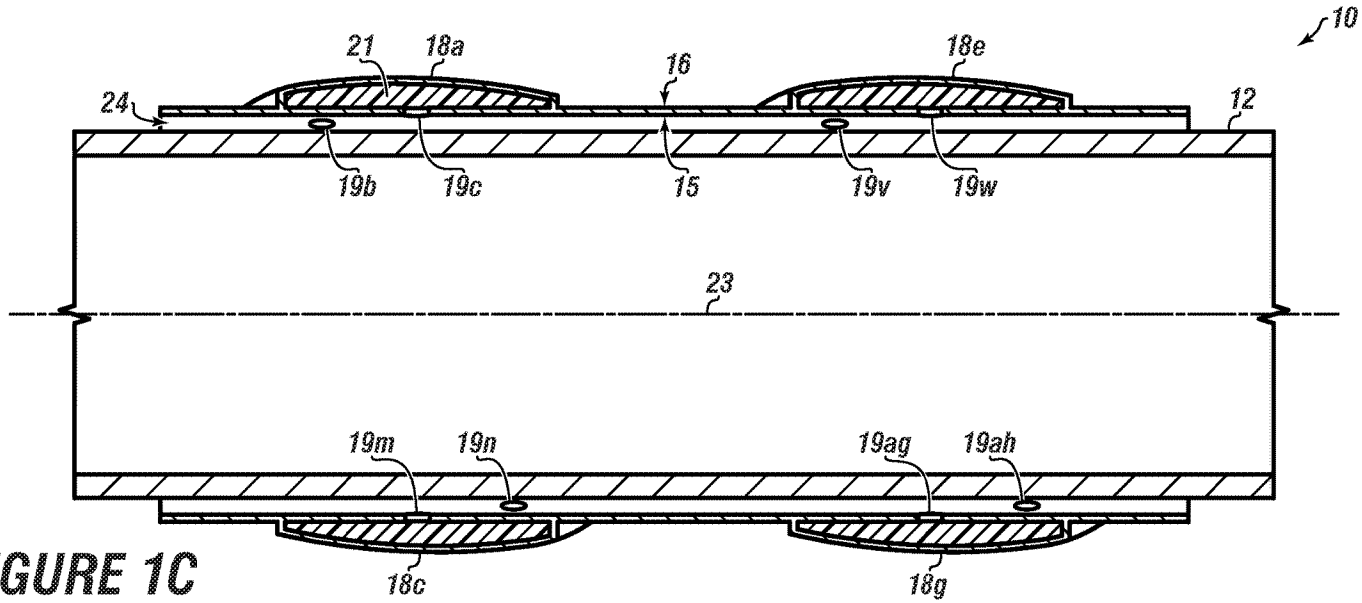

FIG. 1C is a cross sectional view of a hollow vane version of the centralizer system before an injectable material is added to the annulus but is already added to the hollow vanes.

Figure 1D:
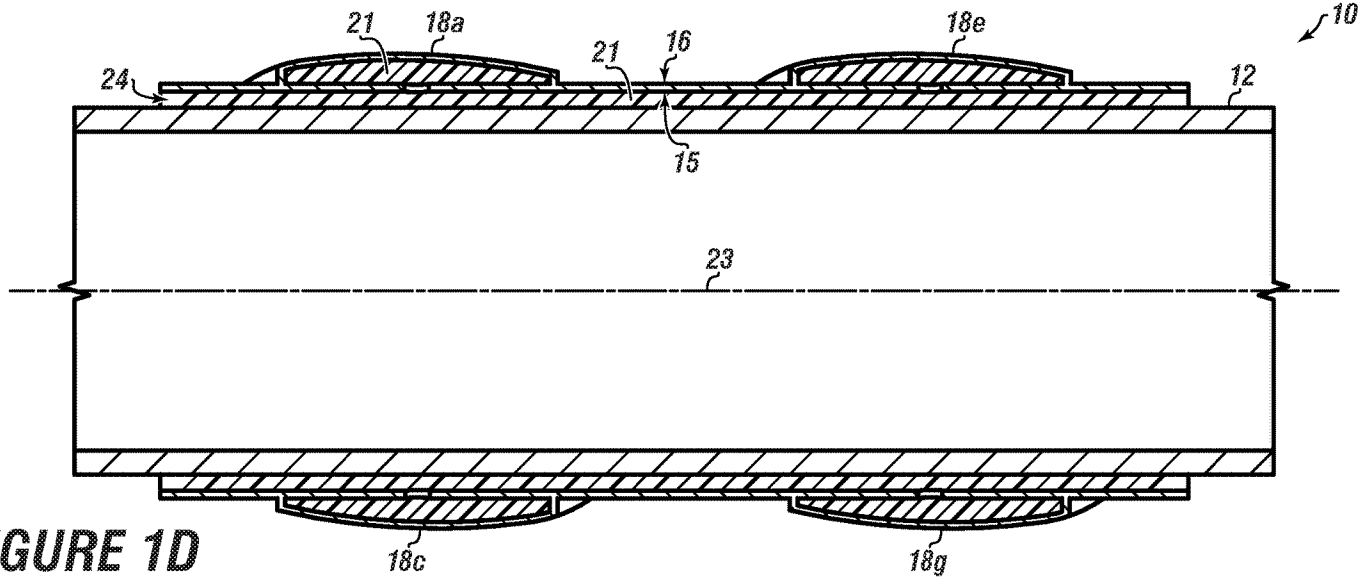
Figure 1E:
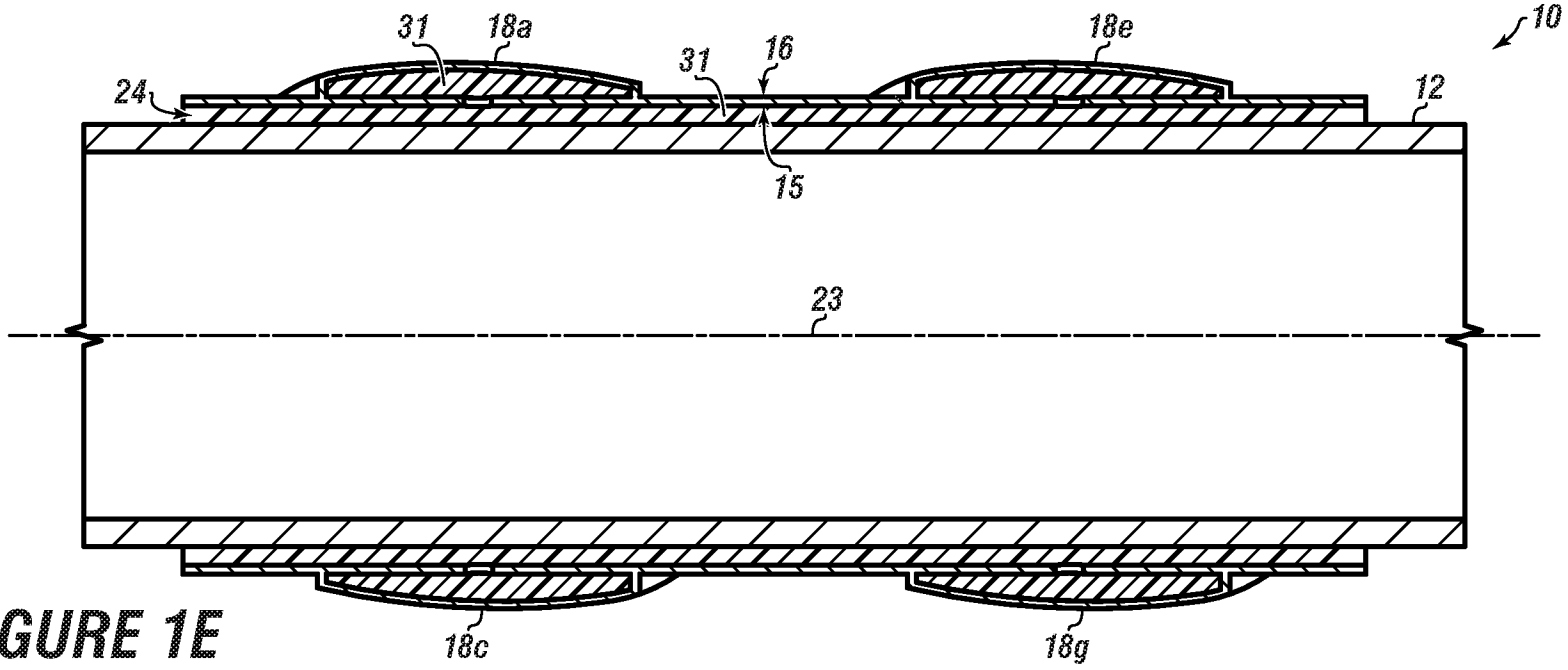

FIG. 1D is a cross sectional view of a hollow vane version of the centralizer system after an injectable material has been simultaneously added to the annulus and the hollow vanes FIG. 1E is a cross sectional view of a hollow vane version of the centralizer system after a swellable encapsulation and shape shifting material has been simultaneously added to the annulus and the hollow vanes.

FIGS. 1A-1E show a stress-free centralizer system 10 with a centralizer portion 14, the centralizer portion can have an inner surface 15 and an outer surface 16 for engaging a wellbore tubular 12. The centralizer portion can have a longitudinal axis 23.

In embodiments, the centralizer portion can have at least one extension 88*a*, 88*b* connected to a vane portion 17. The at least one extension 88*a*, 88*b* can be connected on opposite sides of the vane portion 17.

In embodiments, the vane portion 17 can be between two extensions. The vane portion 17 can have a plurality of hollow vanes 18*a*-18*h*. Each hollow vane of the plurality of hollow vanes can separately extend from the outer surface 16.

In embodiments, the vane portion and the at least one extension can be a one piece integral unit, which means that they can be seamlessly formed.

In embodiments, a plurality of thru-holes 19*a*-19*ah* can be formed in the plurality of hollow vanes 18*a*-18*h*. In embodiments, at least one hollow vane can have at least one thru-hole.

In embodiments, an injectable material 21 can be inserted through the plurality of thru-holes into each of the plurality of hollow vanes while simultaneously filling an annulus 24 that can be formed between the centralizer portion 14 and the wellbore tubular 12. In embodiments, the injectable material can be in a liquid state.

In embodiments, the injectable material 21 can be configured to harden to a hardness of at least 50 shore A and withstand temperatures and pressures within a wellbore for at least twenty-four hours without melting or degrading after hardening within each of the plurality of hollow vanes and the annulus.

In embodiments, a swellable encapsulation and shape shifting material 31 can be injected into each of the plurality of hollow vanes while simultaneously filling the annulus 24 between the centralizer portion 14 and the wellbore tubular 12. In embodiments, the swellable encapsulation and shape shifting material can be in a liquid state.

The swellable encapsulation and shape shifting material 31 can be at least one of: a polymer system and an epoxy system. Each polymer system or epoxy system can be configured to swell to a hardness of at least 50 shore A and withstand temperatures and pressures within a wellbore for at least twenty-four hours without melting after swelling.

In embodiments, the stress-free centralizer system 10 can receive a wellbore tubular 12 longitudinally within the centralizer portion 14. The hollow vane stress free centralizer system 10 can be configured to simultaneously (i) prevent axial movement of the centralizer portion about the wellbore tubular, (ii) prevent rotational movement of the centralizer portion while installed on the wellbore tubular, (iii) distribute load evenly preventing stress riser around the centralizer portion, and (iv) provide cathodic protection to the wellbore tubular without using a stop collar fastened to the wellbore tubular.

In embodiments, the inner surface 15 and the outer surface 16 are preferably clean and free of debris, oil and grease.

In embodiments, from 1 thru-hole to 5 thru-holes per vane can be used.

In embodiments, the injectable material 21 can be at least one of: a plastic, a rubber, a polymeric material, an elastomer, a composite, and a resin.

In embodiments, usable composites for the injectable material 21 can be blends of the aforementioned resins with another component, such as a fiber. Fibers, such as nanocarbon fiber tubes, fiberglass, and similar fibers can be blended into the injectable material.

In embodiments, the plurality of hollow vanes 18*a*-18*h* can be formed from the outer surface 16 of the centralizer portion 14. In embodiments, the plurality of hollow vanes can be helically oriented around the longitudinal axis 23 of the centralizer portion 14.

FIGS. 2A-2D depict a solid vane embodiment of a stress-free centralizer system for wellbore tubulars.

Figure 2A:
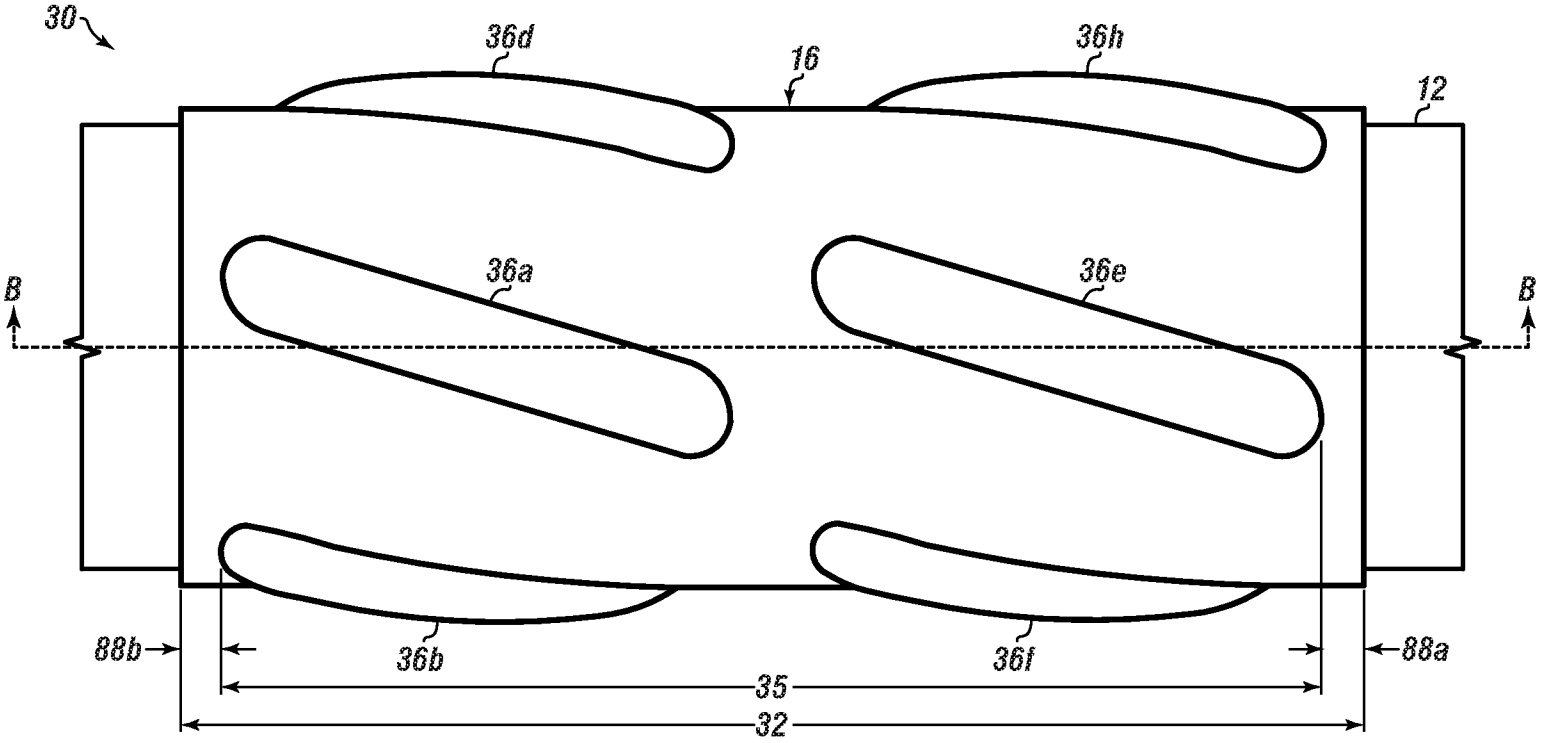
FIGS. 2A-2D depict a solid vane embodiment of a stress-free centralizer system for wellbore tubulars.
Figure 2B:
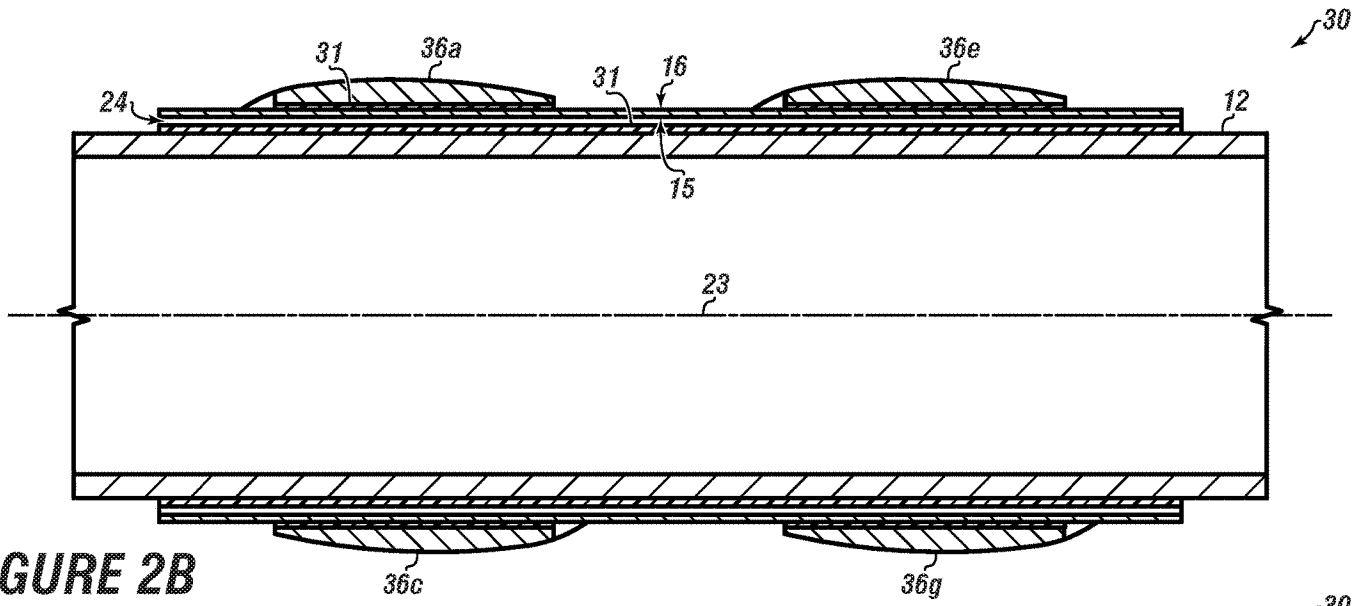

FIG. 2A depicts a side view with cutline B-B. FIG. 2B shows a cross sectional view along the cutline B-B with a swellable encapsulation and shape shifting material prior to swelling.

Figure 2C:
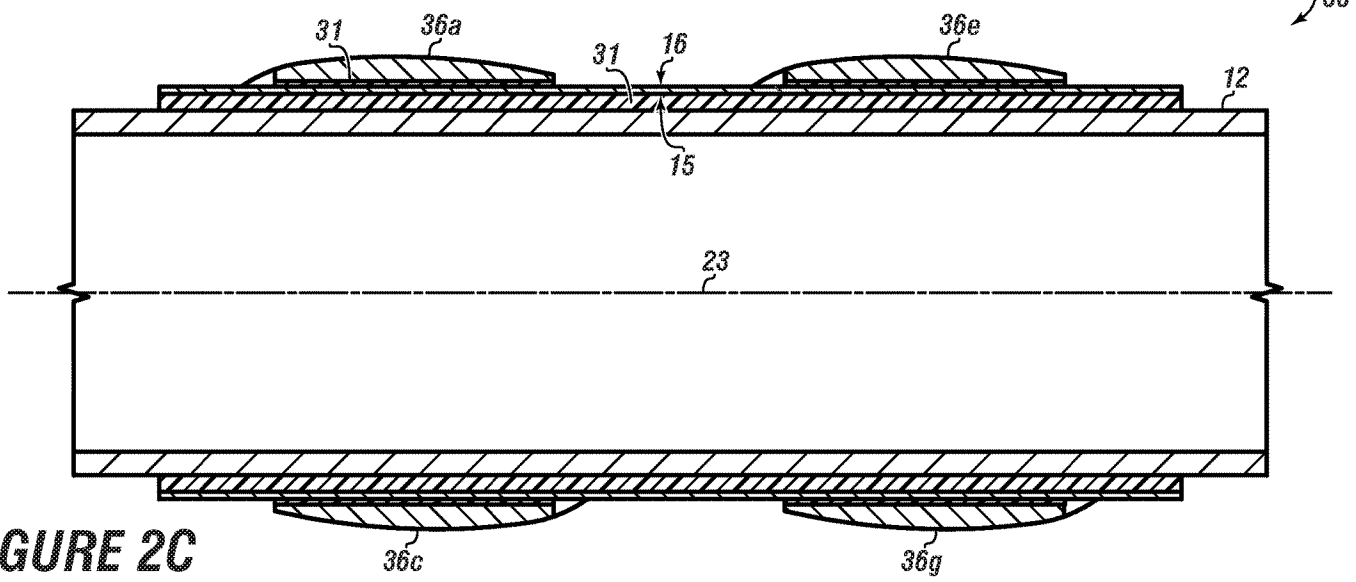

FIG. 2C is a cross sectional view of a solid vane portion of the centralizer system with a swellable encapsulation and shape shifting material in the annulus after swelling.

Figure 2D:
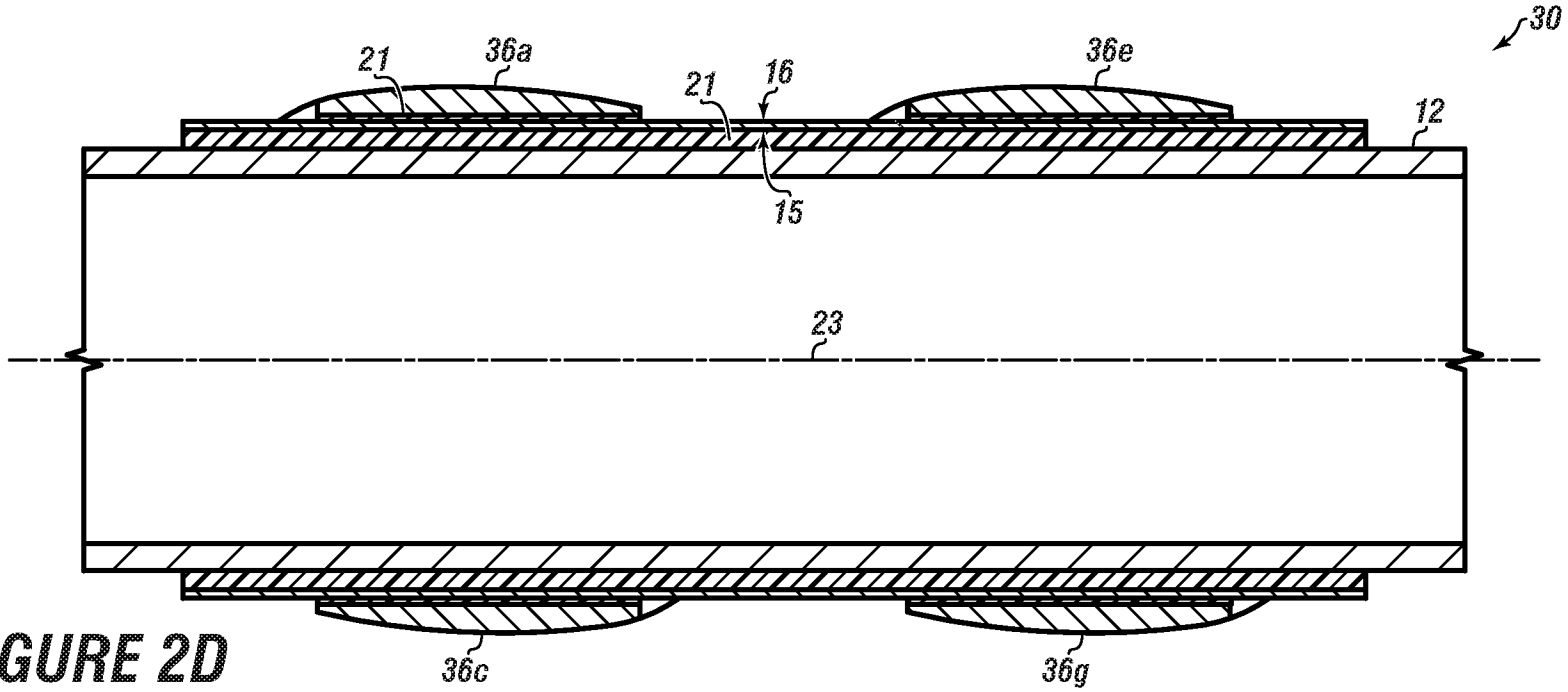

FIG. 2D shows a cross sectional view of a solid vane portion of the centralizer system with an injectable material in the annulus after hardening.

FIGS. 2A-2D show a stress-free solid vane centralizer system 30 with a solid vane centralizer portion 32 with an inner surface 15 and an outer surface 16 and a longitudinal axis 23.

In embodiments, the solid vane centralizer portion 32 can have at least one extension 88*a*, 88*b* on opposite sides of a solid vane portion 35. The solid vane portion 35 can be integrally connected to at least one extension 88*a*, 88*b*.

In embodiments, the solid vane portion 35 can have a plurality of solid vanes 36*a*-36*h*, which can extend from the outer surface 16.

In embodiments, a swellable encapsulation and shape shifting material 31 can be installed in an annulus 24 between a wellbore tubular 12 and the solid vane centralizer portion 32.

The swellable encapsulation and shape shifting material 31 can be at least one of: a polymer system and an epoxy system. Each polymer system or epoxy system can be configured to swell to a hardness of at least 50 shore A and withstand temperatures and pressures within a wellbore for at least twenty-four hours without melting after swelling.

In embodiments, an injectable material 21 can fill the annulus 24 between the wellbore tubular 12 and the solid vane centralizer portion 32. The injectable material 21 can be configured to harden to a hardness of at least 50 shore A and withstand temperatures and pressures within a wellbore for at least twenty-four hours without melting after hardening.

In embodiments, the solid vane portion 35 can have the wellbore tubular 12 disposed longitudinally within the solid vane centralizer portion 32 engaging the swellable encapsulation and shape shifting material 31 or the injectable material 21.

In embodiments, the solid vane stress-free centralizer system 30 can be configured to simultaneously (i) prevent axial movement of the solid vane centralizer portion 32 about the wellbore tubular 12, (ii) prevent rotational movement of the solid vane centralizer portion 32 while installed on the wellbore tubular 12, (iii) distribute load evenly preventing stress riser around the solid vane centralizer portion 32, and (iv) provide cathodic protection to the wellbore tubular 12 without using a stop collar fastened to the wellbore tubular.

In embodiments, the solid vane centralizer portion 32 can have a plurality of solid vanes formed on the outer surface.

In embodiments, the plurality of solid vanes can be helically oriented around the longitudinal axis 23 of the solid vane centralizer portion.

FIGS. 3A-3D depict a stress-free clamp receiving centralizer system with hollow vanes for wellbore tubulars.

Figure 3A:
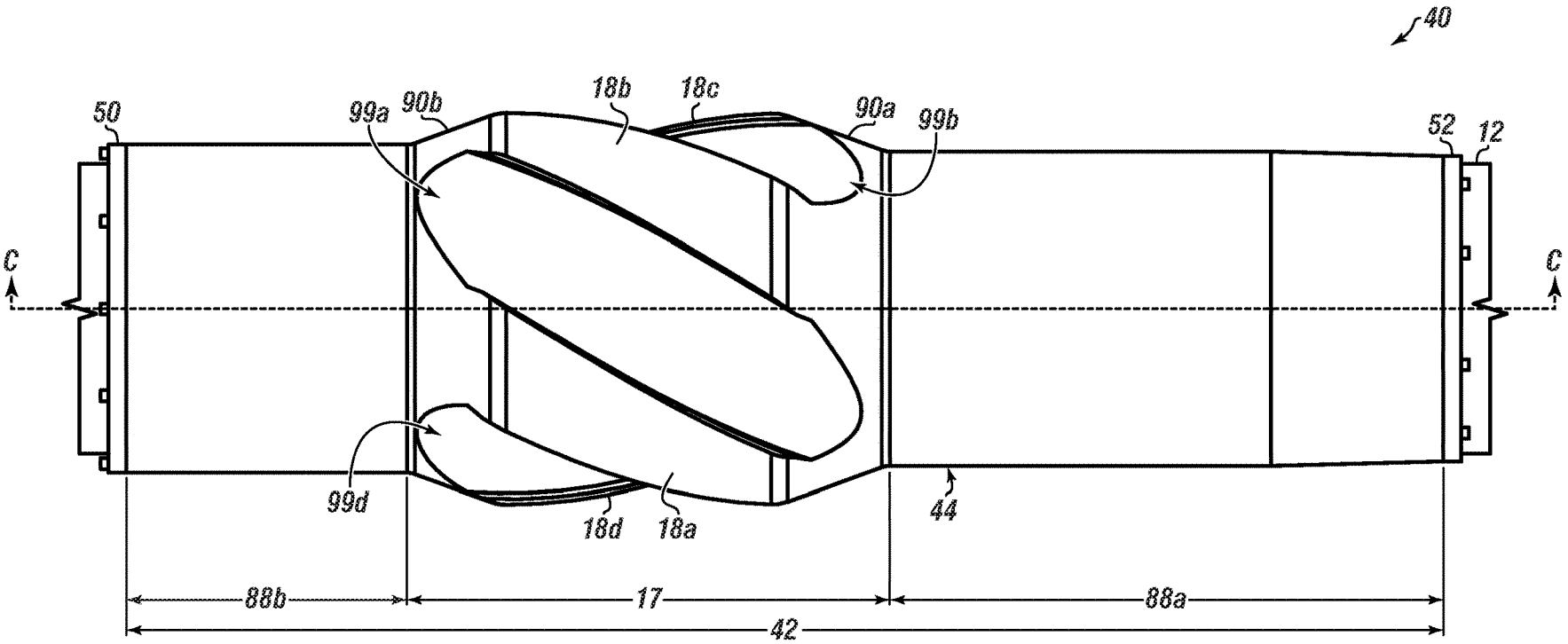
FIGS. 3A-3D depict a stress-free clamp receiving centralizer system with hollow vanes for wellbore tubulars.
Figure 3B:
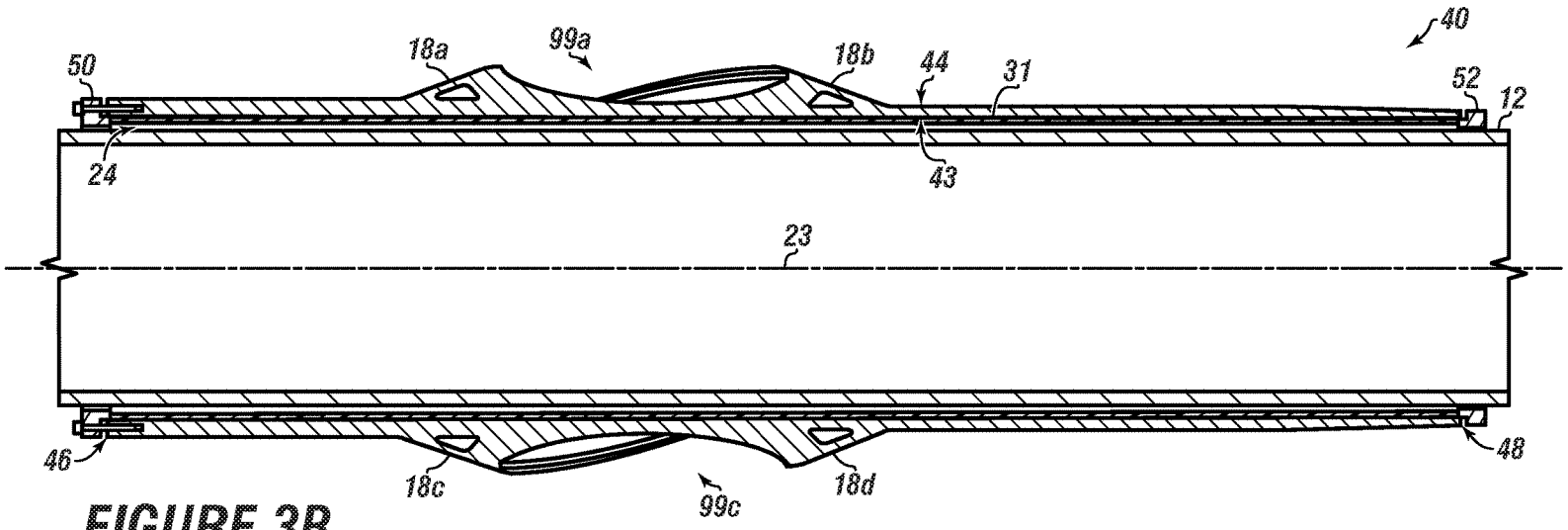

FIG. 3A depicts a side view with cutline C-C. FIG. 3B shows a cross sectional view along the cutline B-B with a swellable encapsulation and shape shifting material prior to swelling.

Figure 3C:
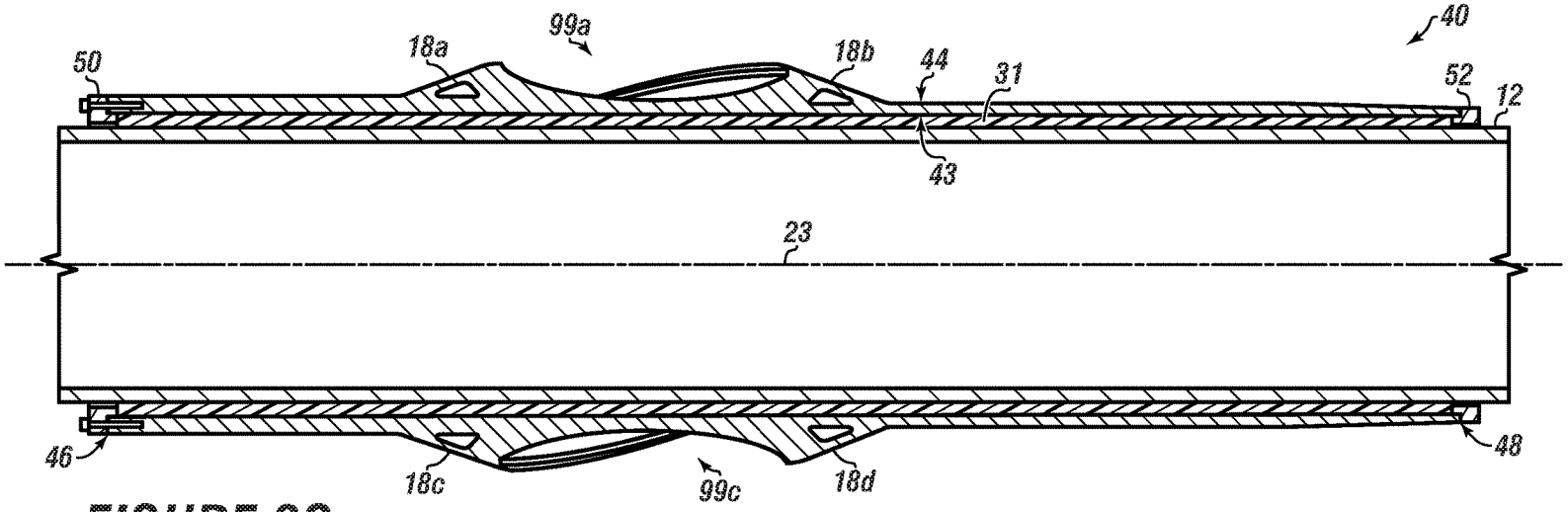

FIG. 3C is a cross sectional view of the stress-free clamp receiving centralizer system with hollow vanes taken along cutline C-C with a swellable encapsulation and shape shifting material after hardening.

Figure 3D:
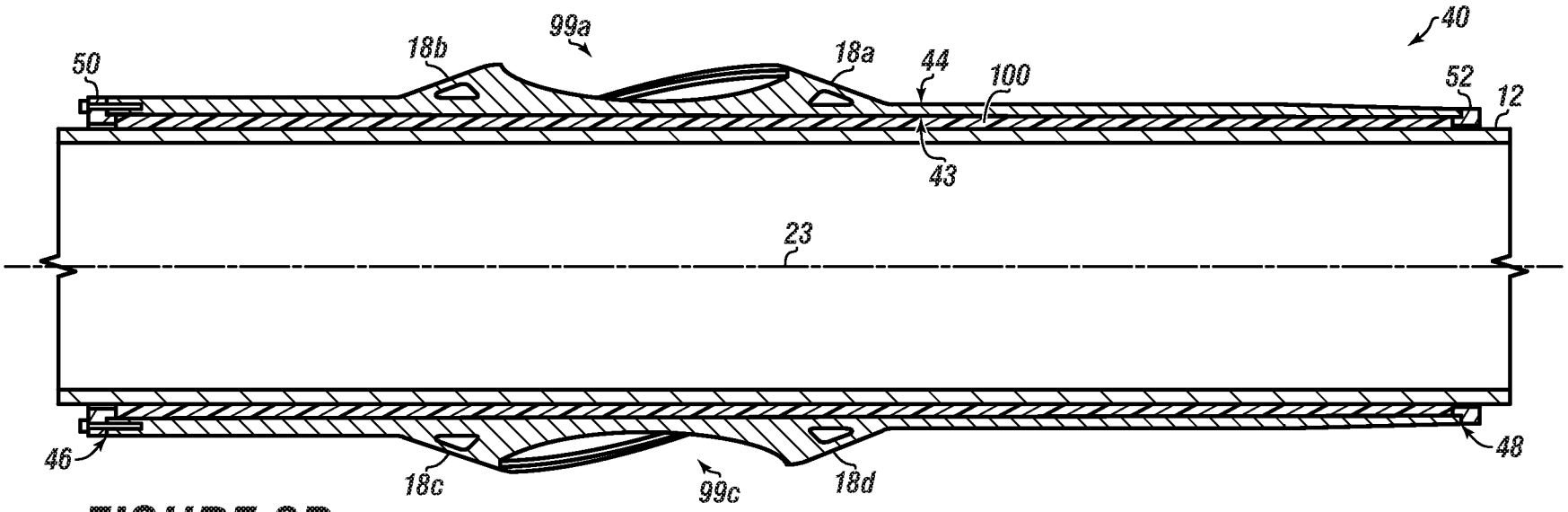

FIG. 3D is a cross sectional view of the stress-free clamp receiving centralizer system taken cutline C-C with a swellable encapsulation and shape shifting material after hardening.

FIGS. 3A-3D show a stress-free clamp receiving centralizer system 40 with a clamp receiving centralizer portion 42 with a clamp receiving inner surface 43 and a clamp receiving outer surface 44, a longitudinal axis 23, a first end 46 and a second end 48.

In embodiments, the clamp receiving centralizer portion 42 can have at least one extension 88*a*, 88*b*. In embodiments, the at least one extension can be 10 percent to 50 percent longer than other extensions used. The at least one extension can be integral with a vane portion 17.

In embodiments, the vane portion 17 can have a plurality of hollow vanes 18*a*-18*d*. In embodiments, the plurality of hollow vanes 18*a*-18*d* can extend from the clamp receiving outer surface 44.

In embodiments, a swellable encapsulation and shape shifting material 31 can fill an annulus 24 between a wellbore tubular 12 and the clamp receiving inner surface 43.

The swellable encapsulation and shape shifting material 31 simultaneously can swell into the hollow vanes 18*a*-18*d* via thru-holes for each hollow vane.

The swellable encapsulation and shape shifting material 31 can be at least one of a polymer system and an epoxy system, configured to swell to a hardness of at least 50 shore A and withstand temperatures and pressures within a wellbore for at least twenty-four hours without melting after swelling.

In embodiments, a non-swelling polymeric material 100 with elastic properties can engage a first clamp 50 and a second clamp 52. In embodiments, the non-swelling polymeric material 100 can be nitrile.

In embodiments, the first clamp 50 can be secured to the first end 46 of the clamp receiving centralizer portion 42 and to either the swellable encapsulation and shape shifting material 31 or the non-swelling polymeric material 100 with elastic properties. The second clamp 52 can be secured to the second end 48 and to the swellable encapsulation material or the non-swelling polymeric material 100 with elastic properties.

The first clamp 50, the second claim 52, both the first claim and the second clamp simultaneously can squeeze the swellable encapsulation and shape shifting material 31 or the non-swelling polymeric material 100 toward the vane portion 17 longitudinally.

The second clamp can squeeze the swellable encapsulation and shape shifting material 31 or the non-swelling polymeric material 100 with elastic properties toward the vane portion longitudinally but in an opposite direction to the first clamp.

In embodiments, the stress-free clamp receiving centralizer system 40 can be configured to simultaneously (i) prevent axial movement of the clamp receiving centralizer portion 42 about the wellbore tubular 12, (ii) prevent rotational movement of the clamp receiving centralizer portion about the wellbore tubular, (iii) distribute load evenly around the clamp receiving centralizer portion, and (iv) provide cathodic protection to the wellbore tubular without using a stop collar fastened to the wellbore tubular.

The formed stress-free clamp receiving centralizer system 40 can be configured to simultaneously (i) prevent axial movement of the clamp receiving centralizer portion about the wellbore tubular, (ii) prevent rotational movement of the clamp receiving centralizer portion about the wellbore tubular, (iii) distribute load evenly around the clamp receiving centralizer portion, and (iv) provide cathodic protection to the wellbore tubular without using a stop collar with screws.

In embodiments, the swellable encapsulation and shape shifting material 31 or the non-swelling polymeric material 100 can still be operational if the material has degraded to 50 percent.

The stress-free clamp receiving centralizer system 40 can have a plurality of flutes 99*a*-99*d*, wherein each flute can be formed between pair a of hollow vanes 18*a*-18*b*.

In embodiments, the plurality of flutes can be formed partly in sloped edges 90*a*, 90*b* simultaneously. In embodiments, the plurality of flutes can connect to the sloped edges. The sloped edges can be integrally connecting the vane portion 17 to at least one extension 88*a*, 88*b*. Each sloped edge 90*a*, 90*b* can have a slope formed at an angle from 1 degree to 50 degrees from the longitudinal axis 23 of the clamp receiving centralizer portion 42.

The sloped edges can also be referred to as "chamfered edges" herein.

Figure 4A:
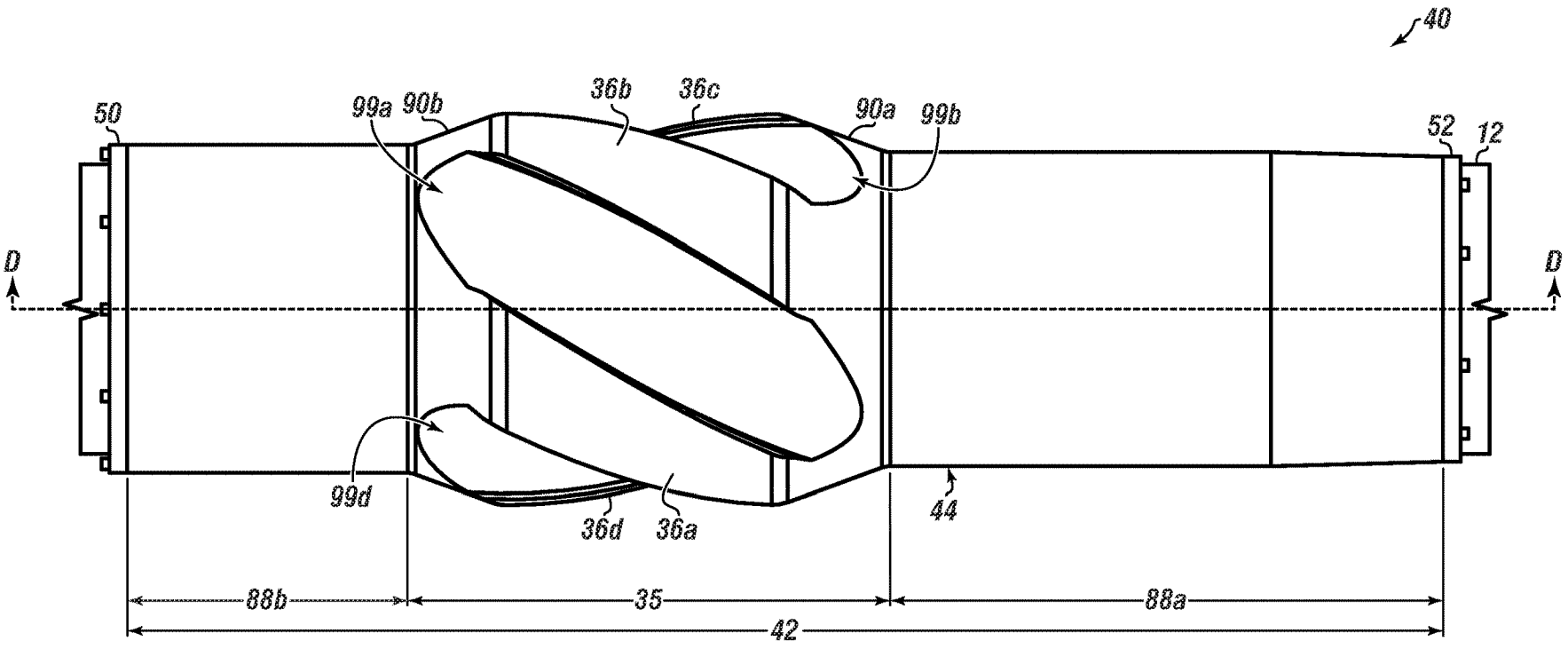
FIGS. 4A-4C depict a clamp receiving centralizer assembly with solid vanes.
Figure 4B:
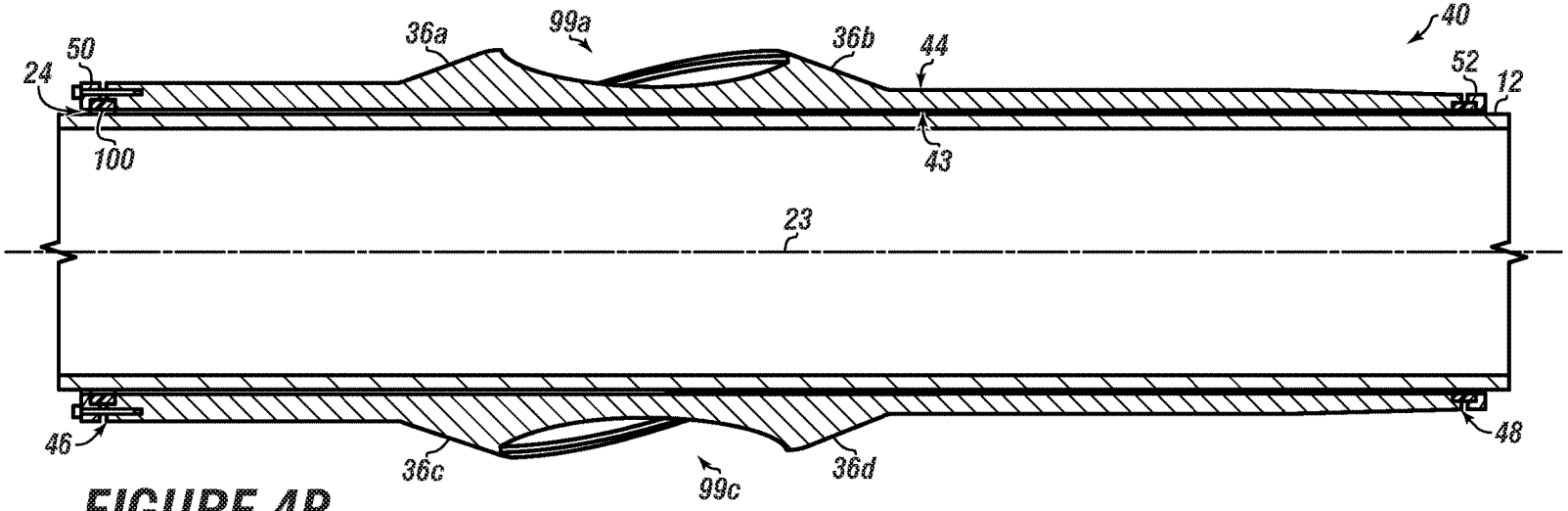
Figure 4C:
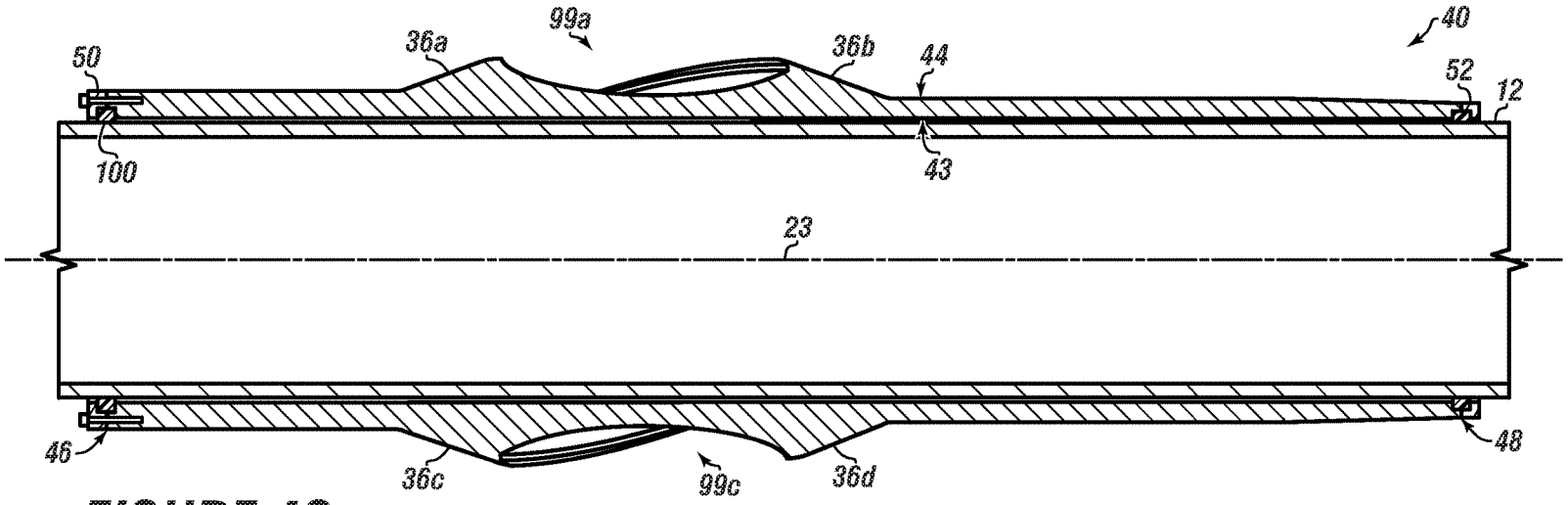

FIGS. 4A-4C depict a stress-tree clamp receiving centralizer system with solid vanes for wellbore tubulars.

FIG. 4A depicts a side view of the stress-free clamp receiving centralizer system with solid vanes with cutline D-D. FIG. 4B is a cross sectional view of the stress-free clamp receiving centralizer system with solid vanes taken along cutline D-D with a non-swelling polymeric material with elastic properties before squeezing.

FIG. 4C is a cross sectional view of the stress-free clamp receiving centralizer system with solid vanes taken along cutline D-D with a non-swelling polymeric material 100 with elastic properties after squeezing.

FIGS. 4A-4C show a stress-free clamp receiving centralizer system 40 with a clamp receiving centralizer portion 42 with a clamp receiving inner surface 43 and a clamp receiving outer surface 44, an annulus 24, a longitudinal axis 23, a first end 46, a second end 48, and a wellbore tubular 12.

In embodiments, the clamp receiving centralizer portion 42 can have at least one extension 88*a*, 88*b*. In embodiments, the at least one extension can be 10 percent to 50 percent longer than other extensions used. The at least one extension can be integral with a solid vane portion 35.

In embodiments, the solid vane portion 35 can have a plurality of solid vanes 36*a*-36*d*. In embodiments, the plurality of solid vanes 36*a*-6*d* can extend from the clamp receiving outer surface 44.

In embodiments, the stress-tree clamp receiving centralizer system 40 can have a plurality of flutes 99*a*-99*d*, each flute formed between pairs of solid vanes.

At least one sloped edge 90*a*, 90*b* can be integrally connecting the solid vane portion 35 to at least one extension 88*a*, 88*b*, wherein the at least one sloped edge has a slope formed at an angle from 1 degree to 50 degrees from the longitudinal axis 23 of the clamp receiving centralizer portion 42.

The stress-free clamp receiving centralizer system 40 can a non-swelling polymeric material 100 with elastic properties, which can be installed between components of a clamp. In embodiments, the non-swelling polymeric material 100 with elastic properties can engage a first clamp 50 and a second clamp 52.

FIGS. 5A-5I depict a solid vane centralizer assembly using a primer and an adhesive.

Figure 5A:
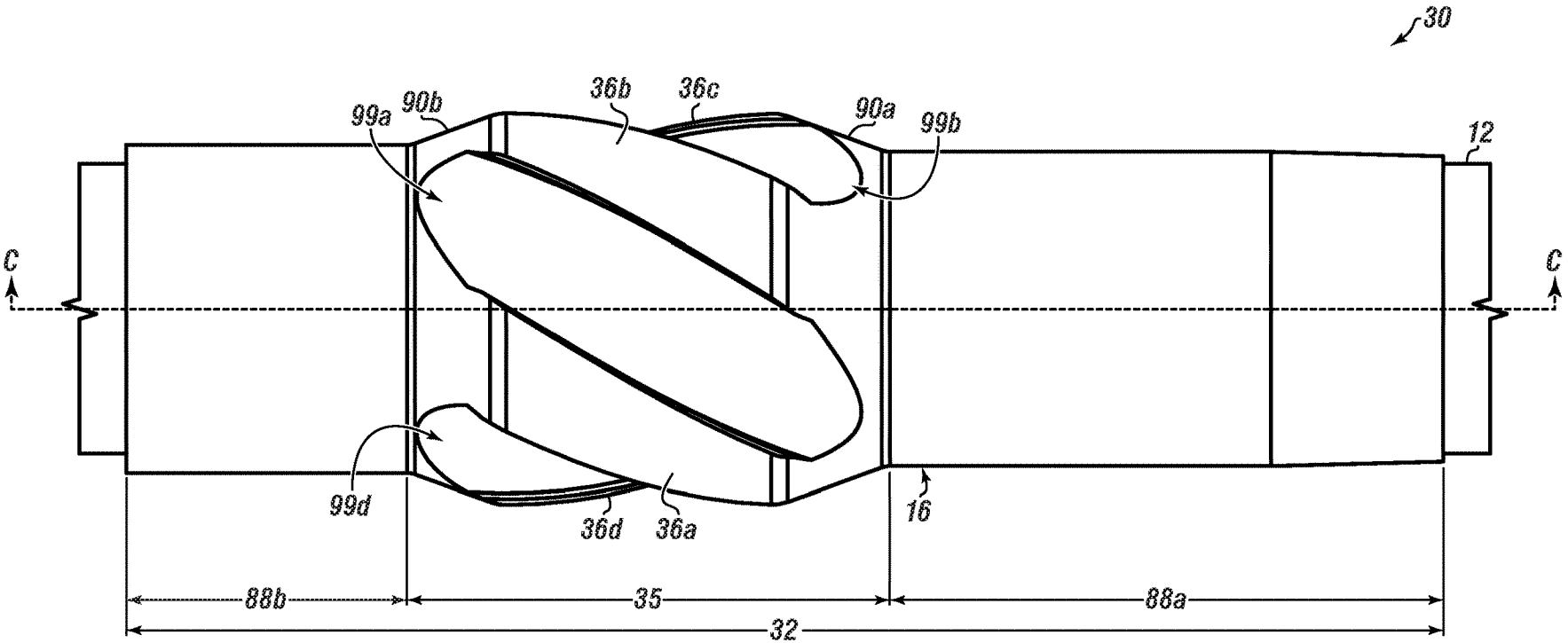
FIGS. 5A-5I depict a solid vane centralizer assembly using a primer and an adhesive.
Figure 5B:
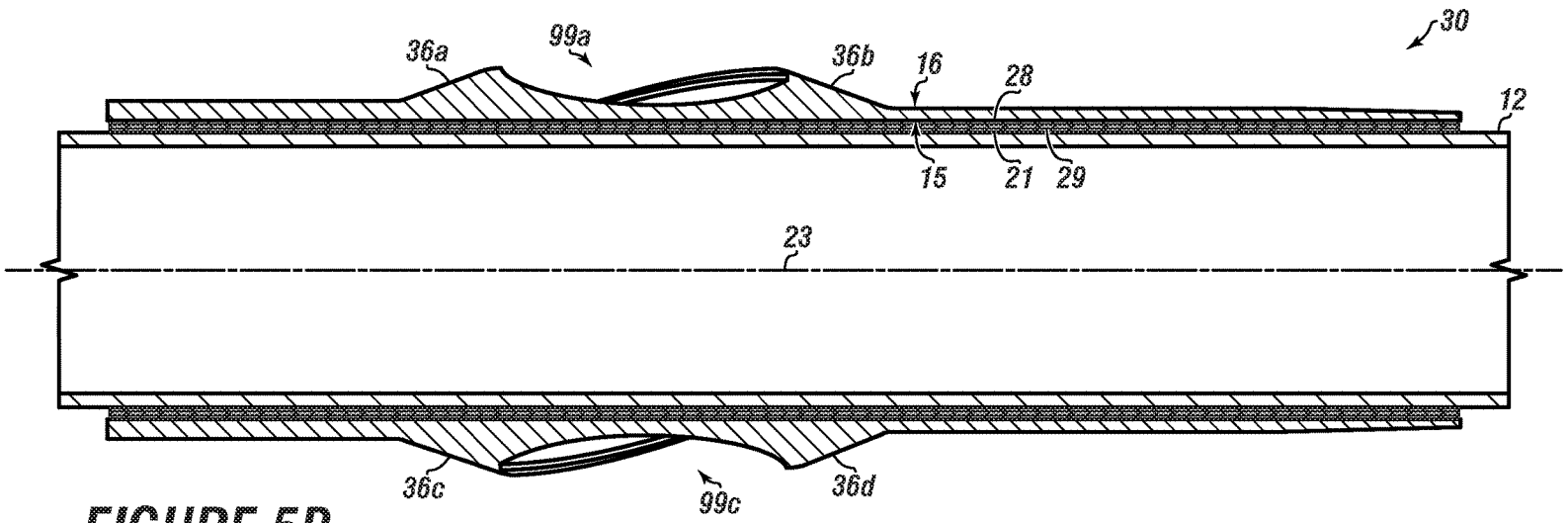
Figure 5C:
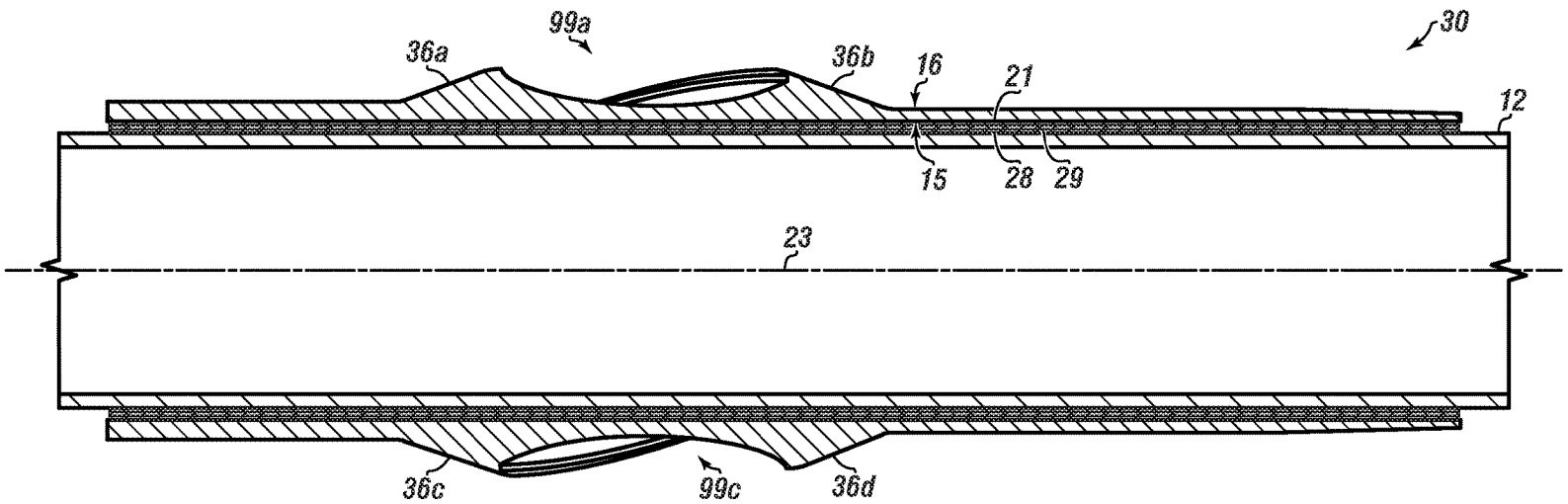
Figure 5D:
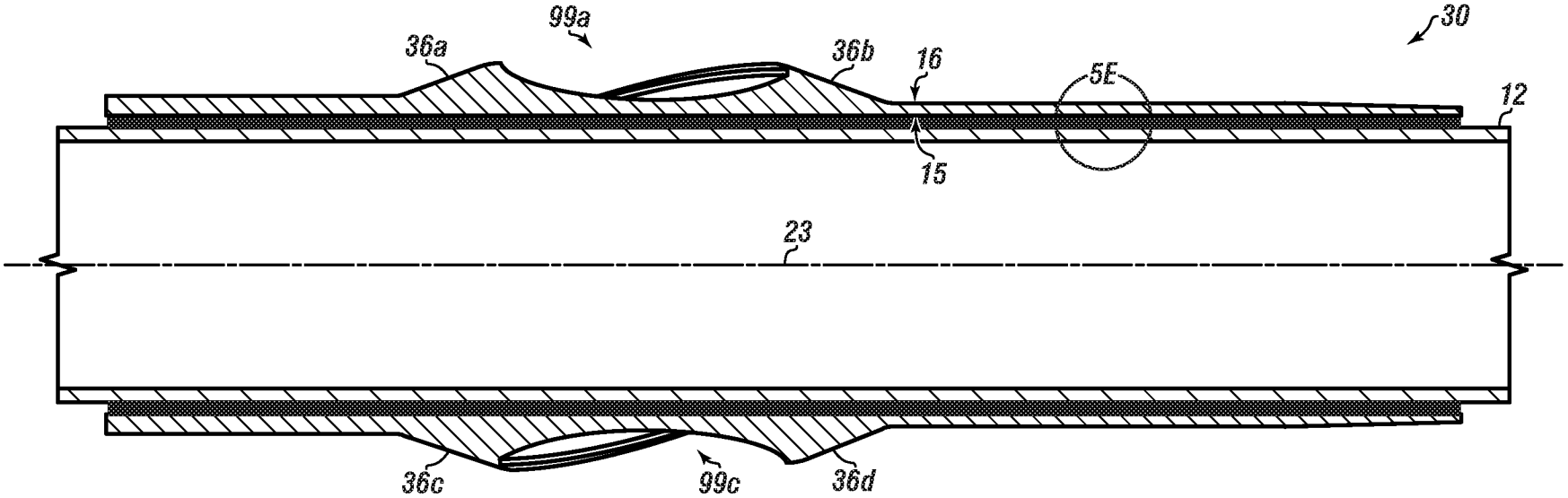
Figure 5E:
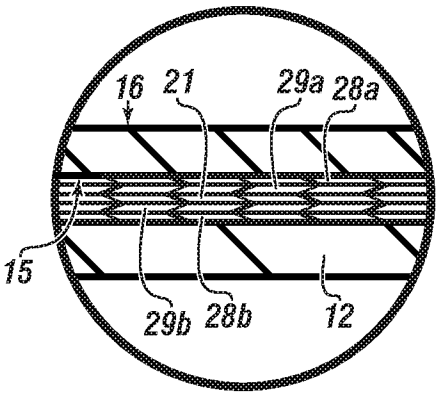
Figure 5F:
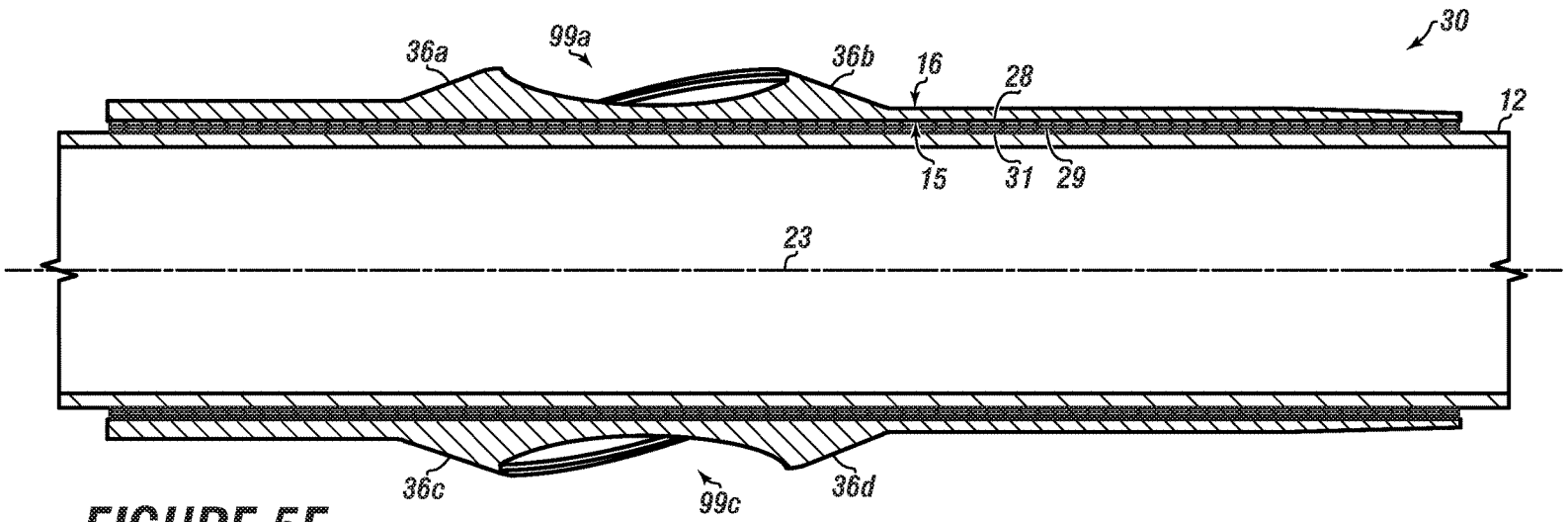
Figure 5G:
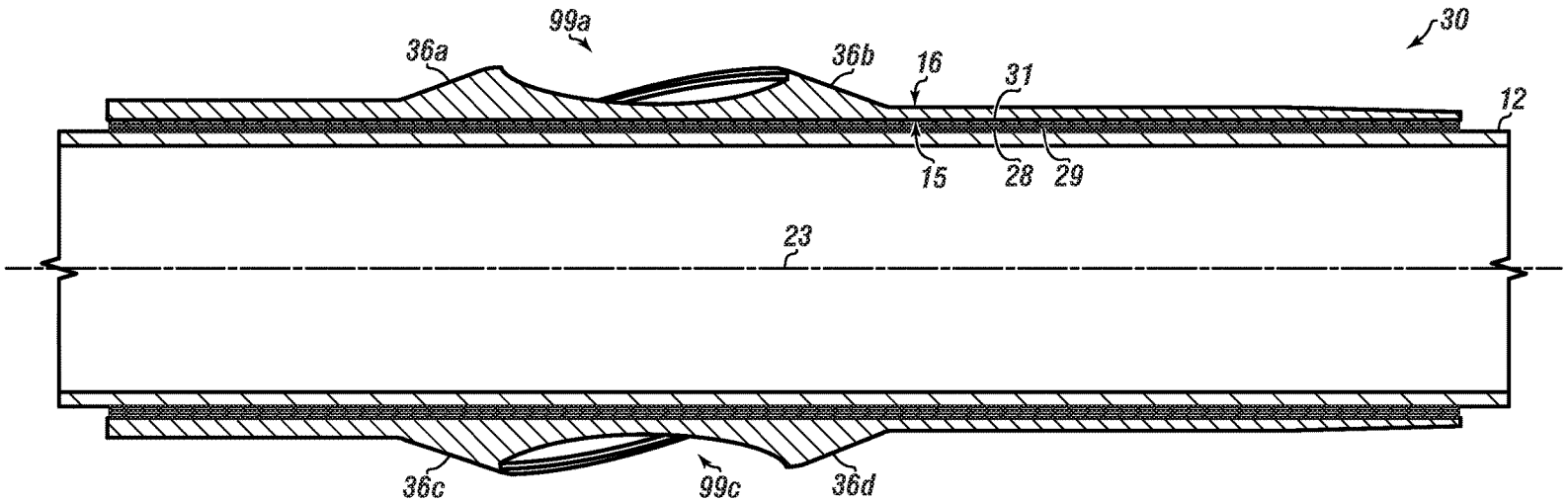
Figure 5H:
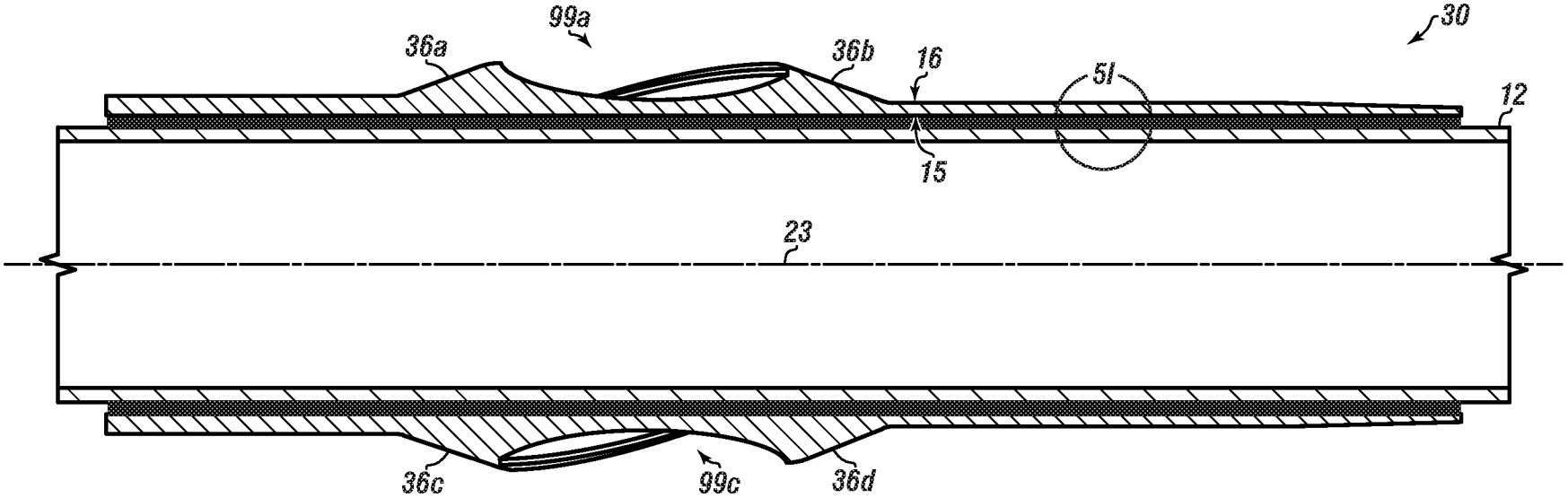
Figure 5I:
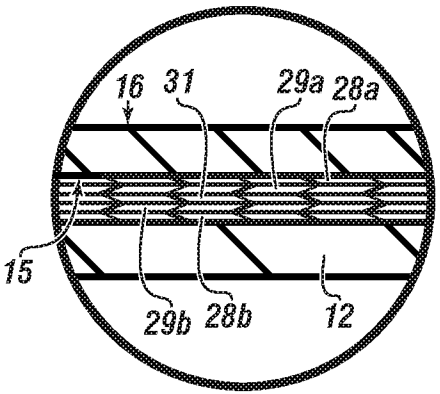

FIG. 5A shows depicts a side view of the solid vane centralizer system w with cutline C-C. FIGS. 5B, 5C and 5D are cross sectional views of the solid vane centralizer system taken along cutline C-C of FIG. 5A. FIG. 5E is an exploded view of a portion of FIG. 5D. FIGS. 5F, 5G and 5H are cross sections views of the solid vane centralizer system taken along cutline C-C of FIG. 5A. FIG. 5I is an exploded view of a portion of FIG. 5H.

The stress-free centralizer system 30 is shown with the solid vane centralizer portion 32 with the outer surface 16 and the inner surface 15, and with a solid vane portion 35 having a plurality of solid vanes 36*a*-36*d*, which can be mounted between two extensions 88*a* and 88*b*. The stress free centralizer system 30 can have a longitudinal axis 23 with sloped edges 90*a* and 90*b* and a plurality of flutes 99*a*-99*d* engaging the wellbore tubular 12.

In embodiments, a primer 28, such as a paint primer for metal objects, can be coated over a portion of an outer surface of the wellbore tubular 12. In embodiments, an adhesive 29 can be painted over the primer 28. In embodiments, the injectable material 21 can be contacted with the adhesive 29.

In embodiments, a swellable encapsulation and shape shifting material 31 can be contacted with the adhesive 29 rather than the injectable material. In embodiments, the solid vane centralizer portion 32 can directly contact the injectable material 21 or the swellable encapsulation and shape shifting material 31.

In embodiments, a first primer 28*a* can be applied to the inner surface 15 of the solid vane centralizer portion. A first adhesive 29*a* can be applied to the first primer 28*a*. In embodiments, the injectable material 21 can be disposed on the first adhesive 29*a*, as shown in FIG. 5E. In embodiments, the swellable encapsulation and shape shifting material 31 can be disposed on the first adhesive 29*a*, as shown in FIG. 5I.

In embodiments, the wellbore tubular 12 can engage the swellable encapsulation and shape shifting material 31 or the injectable material 21.

In embodiments, a second primer 28*b* can be applied to the wellbore tubular 12. A second adhesive 29*b* can be applied to the second primer 28*b*. In embodiments, the second adhesive 299 can connect to and engage the injectable material 21, as shown in FIG. 5E. In embodiments, the second adhesive 29*b* can connect to and engage the swellable encapsulation and shape shifting material 31, as shown in FIG. 5I.

In embodiments, the primer 28 can be applied to the inner surface 15. An adhesive 29 can be applied to the primer 28. A swellable encapsulation and shape shifting material 31 can be disposed over the adhesive 29 and an injectable material 21 can be disposed over the adhesive 29.

FIGS. 6A-6I depict a hollow vane centralizer assembly using a primer and an adhesive.

Figure 6A:
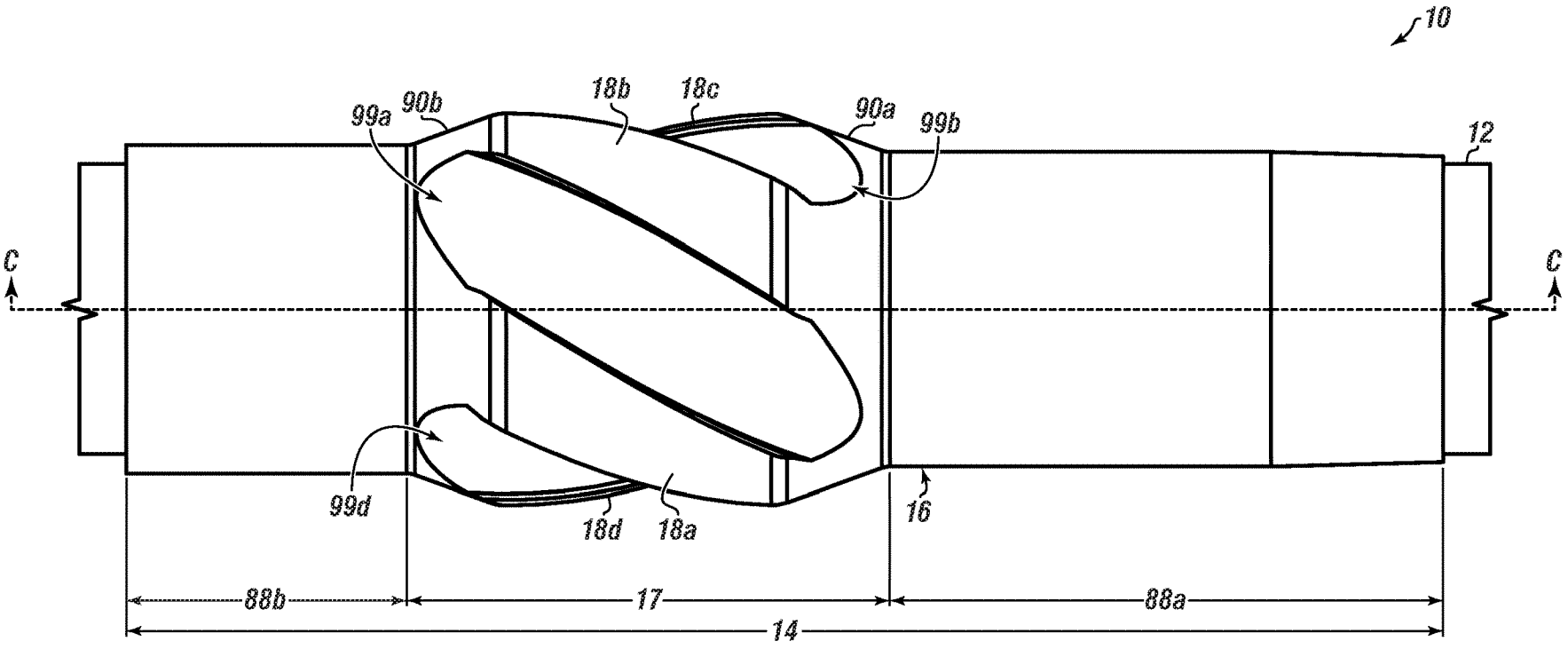
FIGS. 6A-6I depict a hollow vane centralizer assembly using a primer and an adhesive.

FIG. 6A is a side view of the stress-free centralizer system 10 with and centralizer portion 14 a plurality of hollow vanes 18*a*-18*d* engaging the wellbore tubular 12 with a plurality of flutes 99*a*-99*d* formed between the plurality of hollow vanes 18*a*-18*d*. In embodiments, the sloped edges 90*a*, 90*b* and extensions 88*a*, 88*b* can extend from the vane portion 17.

Figure 6B:
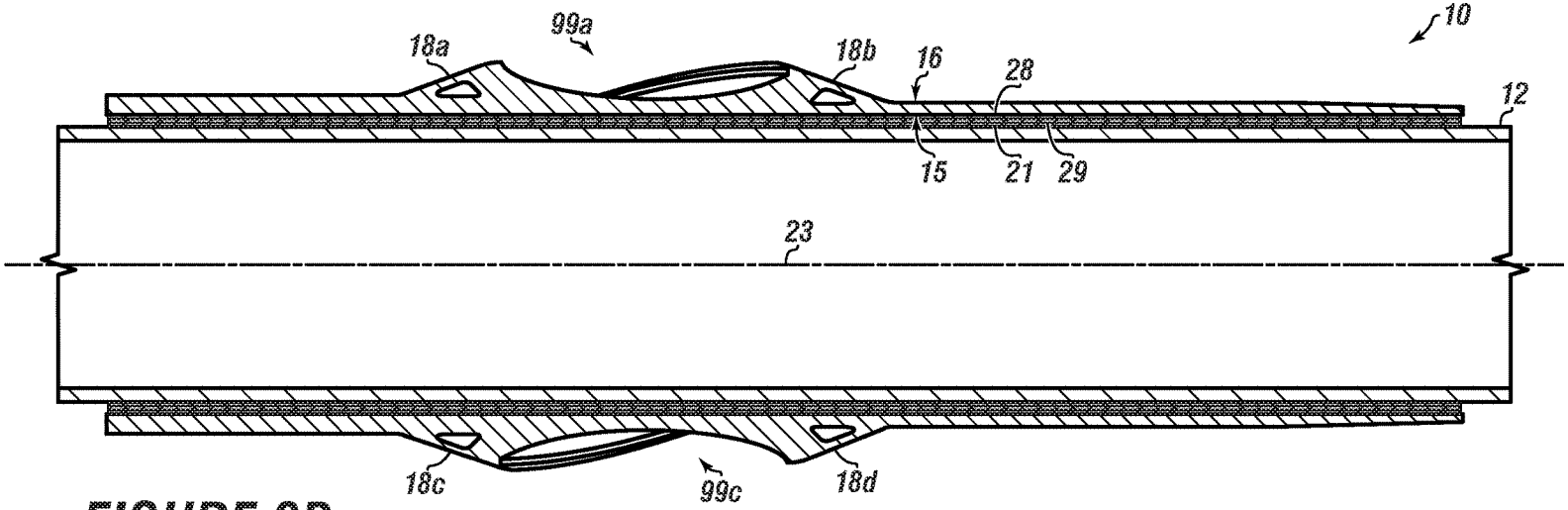

FIG. 6B is a cut view along line C-C of the stress free centralizer system 10 with a longitudinal axis 23, an inner surface 15 and an outer surface 16. The centralizer portion can have a primer 28 disposed on the inner surface 15, an adhesive 29 disposed on the primer 28 and an injectable material 21 covering the adhesive in the annulus.

Figure 6C:
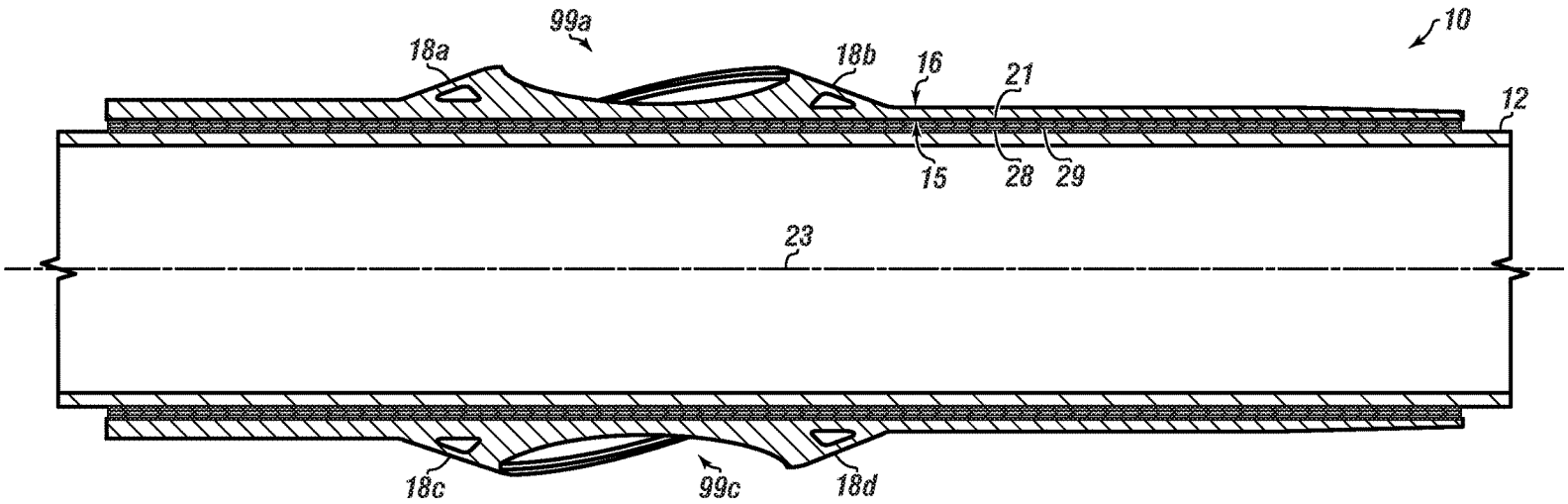

FIG. 6C is a cut view along cutline C-C of the stress free centralizer system 10 with the wellbore tubular 12 having a primer 28 disposed on the outer surface 16, an adhesive 29 disposed on the primer 28 and an injectable material 21 covering the adhesive in the annulus.

Figure 6D:
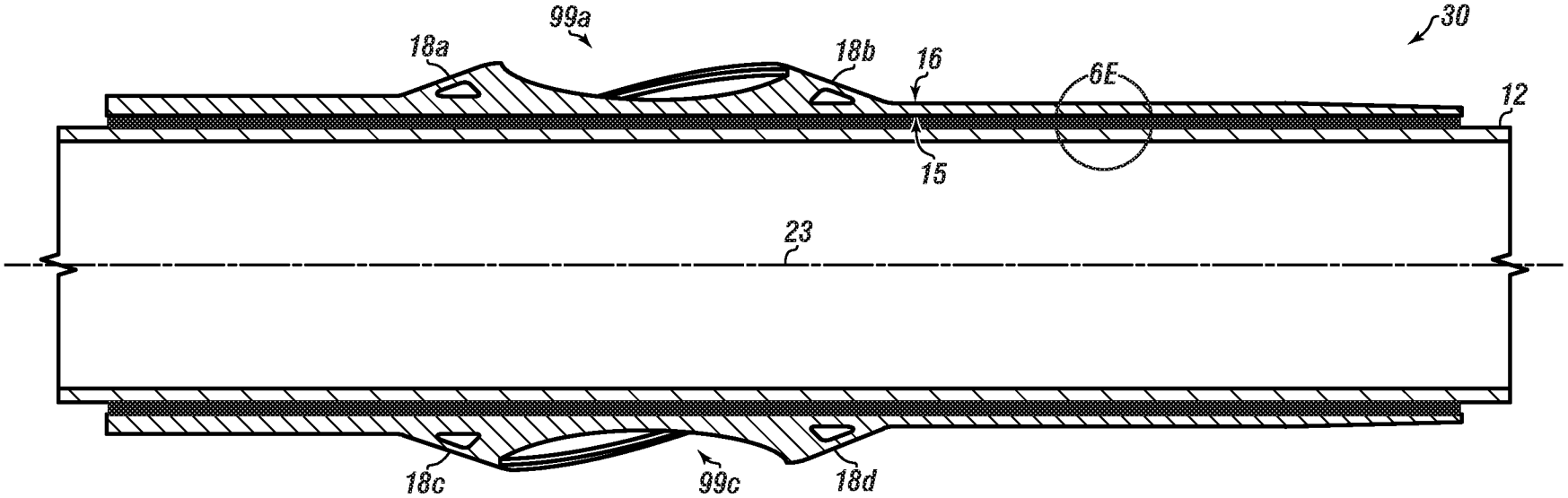
Figure 6E:
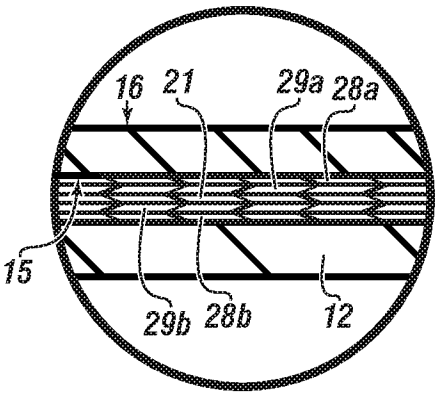

FIG. 6D is a cut view along cutline C-C of the stress free centralizer system 10 and FIG. 6E is an exploded view of a portion of FIG. 6D of the inner surface 15 having a first primer 28*a* disposed therein and a first adhesive 29*a* disposed on the first primer 28*a*. In this embodiment, the injectable material 21 can be disposed on the first primer 21. A second primer 28*b* can be coated on the wellbore tubular 12 and a second adhesive 29*b* can be coated on the second primer 28*b* and contacting the injectable material 21.

Figure 6F:
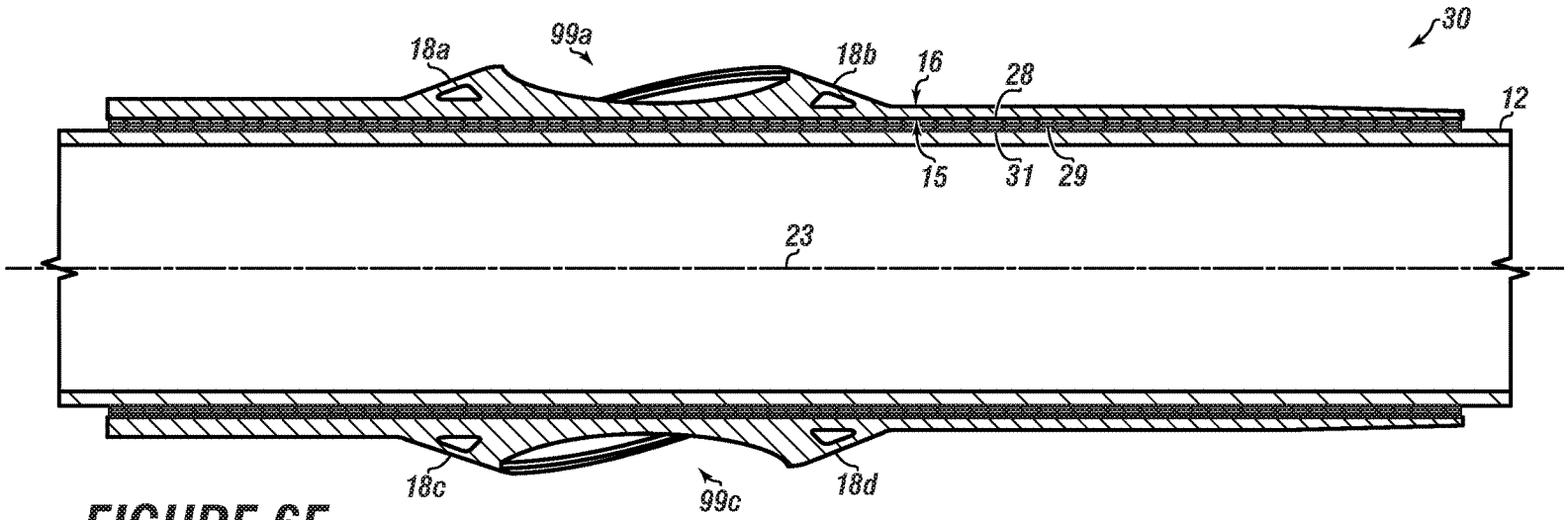

FIG. 6F is a cut view along cutline C-C of the stress free centralizer system 10 showing the centralizer portion having a primer 28 disposed on the inner surface 15, an adhesive 29 disposed on the primer 28 and a swellable encapsulation and shape shifting material 31 covering the adhesive 29 in the annulus.

Figure 6G:
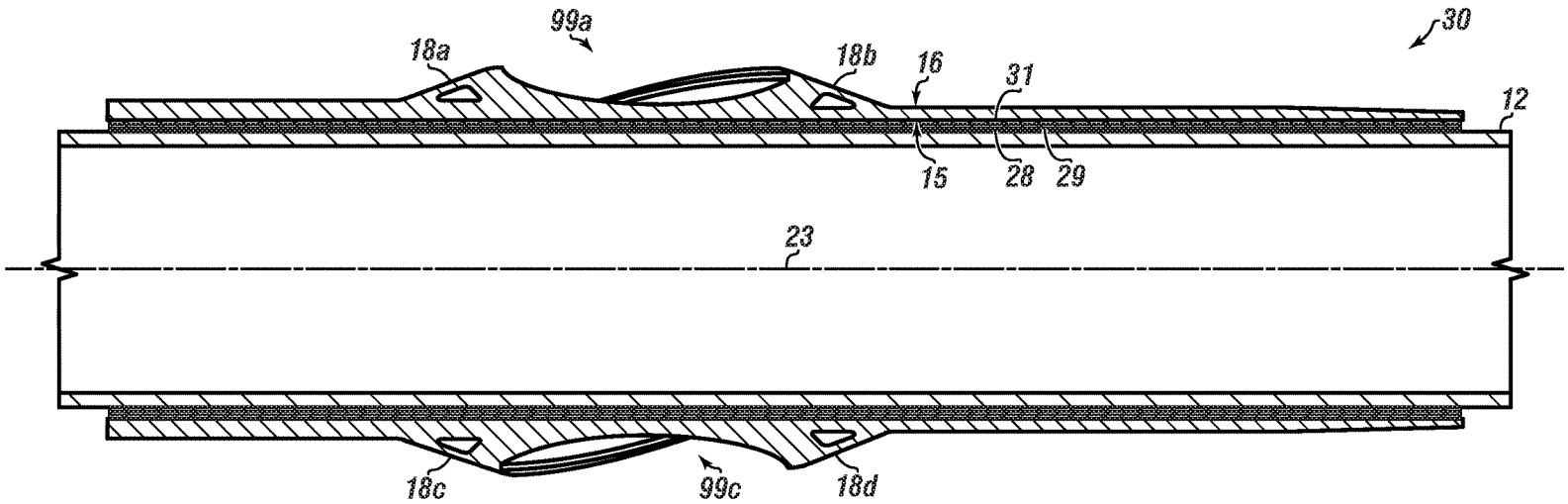

FIG. 6G is a cut view along cutline C-C of the stress free centralizer system 10 showing the wellbore tubular 12 having a primer 28 disposed the outer surface 16, an adhesive 29 disposed on the primer 28 and a swellable encapsulation and shape shifting material 31 covering the adhesive in the annulus.

Figure 6H:
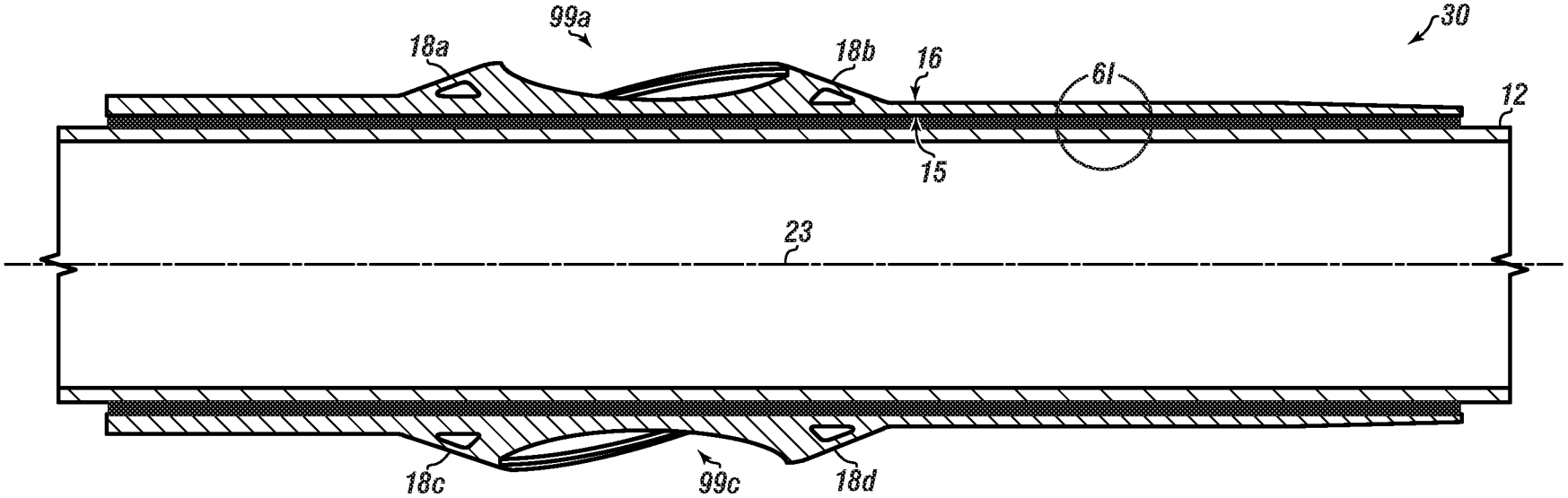
Figure 6I:
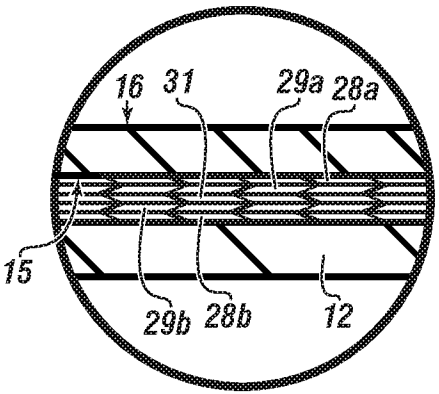

FIG. 6H is a cut view along cutline C-C of the stress free centralizer system 10 and FIG. 6E is an exploded view of a portion of FIG. 6H of the inner surface 15 having a first primer 28*a* disposed therein and a first adhesive 29*a* disposed on the first primer 28*a*. In embodiments, the swellable encapsulation and shape shifting material 31 can be contacted with the first primer 28*a*. A second primer 28*b* can be coated on the wellbore tubular 12 and a second adhesive 29*b* can be coated on the second primer 28*b* and contacting the swellable encapsulation and shape shifting material 31.

While these embodiments have been described with emphasis on the embodiments, it should be understood that within the scope of the appended claims, the embodiments might be practiced other than as specifically described herein.

What is claimed is:

1. A stress-free solid vane centralizer system for a wellbore tubular comprising:

a. a solid vane centralizer portion comprising an inner surface and an outer surface with a longitudinal axis, the solid vane centralizer portion comprising:

i. at least one extension;

ii. a solid vane portion integrally connected to the at least one extension; the solid vane portion comprising a plurality of solid vanes extending from the outer surface; and iii. a swellable encapsulation and shape shifting material or an injectable material filling an annulus between the wellbore tubular and the solid vane centralizer portion, the swellable encapsulation and shape shifting material comprising at least one of: a polymer system and an epoxy system, the polymer system or the epoxy system configured to swell to a hardness of at least 50 shore A and withstand temperatures and pressures within a wellbore for at least twenty-four hours without melting after swelling, the injectable material configured to harden to a hardness of at least 50 shore A and withstand temperatures and pressures within the wellbore for at least twenty-four hours without melting or degrading after hardening; and b. the wellbore tubular disposed longitudinally within the solid vane centralizer portion engaging the swellable encapsulation and shape shifting material or the injectable material, and wherein the wellbore tubular comprises a primer coated over a portion of an outer surface of the wellbore tubular and an adhesive painted over the primer with the injectable material or the swellable encapsulation and shape shifting material disposed over the adhesive; the solid vane stress-free centralizer system configured to simultaneously (i) prevent axial movement of the solid vane centralizer portion about the wellbore tubular, (ii) prevent rotational movement of the solid vane centralizer portion while installed on the wellbore tubular, (iii) distribute load evenly preventing stress riser around the solid vane centralizer portion, and (iv) provide cathodic protection to the wellbore tubular without using a stop collar fastened to the wellbore tubular.

2. The stress-free solid vane centralizer system of claim 1, wherein the plurality of solids vanes are formed from the outer surface of the solid vane centralizer portion.

3. The stress-free solid vane centralizer system of claim 1, wherein the plurality of solid vanes are helically oriented around the longitudinal axis of the solid vane centralizer portion.

4. The stress-free solid vane centralizer system of claim 1, comprising at least one sloped edge integrally connecting the solid vane portion to the at least one extension, wherein the at least one sloped edge has a slope formed at an angle from 1 degree to 50 degrees from the longitudinal axis of the solid vane centralizer portion.

5. The stress-free solid vane centralizer system of claim 4, comprising a plurality of flutes, each flute of the plurality of flutes formed between a pair of solid vanes of the plurality of solid vanes.

6. The stress-free solid vane centralizer system of claim 1, comprising a primer applied to the inner surface of the solid vane centralizer portion, an adhesive applied to the primer and the injectable material or swellable encapsulation and shape shifting material disposed over the adhesive.

7. The stress-free solid vane centralizer system of claim 1, comprising a first primer applied to the inner surface of the solid vane centralizer portion, a first adhesive applied to the first primer, the injectable material or swellable encapsulation and shape shifting material installed on the first adhesive, wherein a second primer is applied to the wellbore tubular, a second adhesive is applied to the second primer and wherein the second adhesive connects to and engages the injectable material or the swellable encapsulation and shape shifting material.

* * * * *